US006270205B1

(12) United States Patent
Takata

(10) Patent No.: US 6,270,205 B1
(45) Date of Patent: Aug. 7, 2001

(54) INK-JET PRINT HEAD WITH INK SUPPLY CHANNEL

(75) Inventor: Masayuki Takata, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/049,046

(22) Filed: Mar. 27, 1998

(30) Foreign Application Priority Data

Mar. 28, 1997 (JP) ..... 9-077257
Mar. 31, 1997 (JP) ..... 9-079601
Mar. 31, 1997 (JP) ..... 9-079602

(51) Int. Cl.[7] ..... B41J 2/175
(52) U.S. Cl. ..... 347/85
(58) Field of Search ..... 347/85, 86, 87, 347/93

(56) References Cited

U.S. PATENT DOCUMENTS 4,680,595 * 7/1987 Cruz-Uribe et al. ..... 347/40
5,519,425 * 5/1996 Dietl et al. ..... 347/87
5,793,396 * 8/1998 Sasaki ..... 347/86
5,808,643 * 9/1998 Tracy et al. ..... 347/92

FOREIGN PATENT DOCUMENTS 0 438 270 A1 7/1991 (EP) .
0 695 642 A2 2/1996 (EP) .
0 705 705 A2 4/1996 (EP) .
0 739 735 A2 10/1996 (EP) .
8-132639 5/1996 (JP) .
9-66604 3/1997 (JP) .

* cited by examiner

*Primary Examiner*—N. Le
*Assistant Examiner*—Michael Nghiem
(74) *Attorney, Agent, or Firm*—Oliff & Berridge, PLC

(57) ABSTRACT

The ink-jet print head 23 is provided with a sloped surface 18 on the inner side surface between the inflow channel 16 and the ink supply channel 14. The sloped surface 18 gradually increases the cross-sectional area of the ink flow path 45 from the inflow channel 16 toward the ink supply channel 14. Accordingly, as the ink flows along the sloped surface 18 into the ink supply channel 14, the rate of flow of the ink gradually decreases due to the increased cross-sectional area provided by the sloped surface 18. As a result, the liquid ink flows more gently into the ink supply channel 14.

32 Claims, 16 Drawing Sheets

INK-JET PRINT HEAD WITH INK SUPPLY CHANNEL

BACKGROUND OF THE INVENTION

1. Field of the Invention

The present invention relates to an ink-jet print head, employed in an ink-jet printing device, for ejecting liquid ink from nozzles onto a recording paper in order to form desired images on the recording paper.

2. Description of the Related Art

Ink-jet type printing devices are well-known in the art for their relatively simple construction and for their high-speed and high-quality printing capabilities. An ink-jet print head is employed in the ink-jet type printing devices.

SUMMARY OF THE INVENTION

A conceivable structure of the ink jet print head is shown in FIGS. 1 and 2. The ink-jet print head includes an actuator 213 and a manifold 215. The actuator 213 is constructed from a piezoelectric ceramic material, for example, and is formed with a plurality of ejection channels 212 for ejecting droplets of liquid ink from nozzles (not shown). The actuator 213 has an upper end surface 208, where the plurality of ejection channels 212 are opened to form their inflow ends.

The manifold 215 is attached to the upper end surface (inflow end surface) 208 of the actuator 213. The manifold 215 is formed with an ink supply channel 214 for supplying liquid ink to the ejection channels 212. The manifold 215 is further formed with an inflow channel 216 in fluid communication with the ink supply channel 214. Liquid ink is transferred through the inflow channel 216 from an ink supply source (not shown) to the ink supply channel 214. Liquid ink is then introduced into the ejection channels 212 of the actuator 213. The actuator 213 is partially applied with electric fields, thereby being partially transformed. The transformation in the actuator 213 causes variations in the volume of ejection channels 212 desired to be actuated. When the volumes of the ejection channels 212 are decreased, the liquid ink in those channels 212 is ejected in droplets from the nozzles. When the volumes of the ejection channels 212 are increased, on the other hand, ink from the ink supply source is introduced into the ejection channels 212 via the inflow channel 216 and the ink supply channel 214.

As shown in FIG. 2, the ink supply channel 214 has a rectangular cross-section. That is, the manifold 215 is formed with an upper horizontal inner wall 217 and a pair of vertical inner walls 209 for surrounding the ink supply channel 214. The upper horizontal inner wall 217 is connected to the pair of vertical inner walls 209 with a right angle being formed therebetween.

The manifold 215 is attached to the actuator 213 so that the upper horizontal inner wall 217 is located facing the upper end surface 208 of the actuator 213 and apart therefrom by a predetermined distance. Thus, the ink supply channel 214 is provided to be entirely opened over the inflow ends of all the ejection channels 212.

As shown in FIG. 1, the manifold 215 is further formed with an inner wall surface 220 for defining the inflow channel 216. The inner wall surface 220 is connected to the inner wall surface 217. An approximately right angle is formed between the inner wall surface 220 and the inner wall surface 217. That is, the inner wall surface 220 extends approximately perpendicularly to the inner wall surface 217. Thus, the ink supply channel 214 extends from and perpendicularly to the inflow channel 216.

With the above-described structure, when ink is initially introduced into the ink-jet print head from the ink supply source (not shown), ink flows into the inflow channel 216 and then continues flowing in the direction of the inflow channel 216 without slowing down its flowing speed. As a result, the ink forcibly hits the upper end surface 208 of the actuator 213, causing the formation of air bubbles. These air bubbles can enter ejection channels 212 and can cause ejection problems such as printing imperfections.

In view of the above-described problem, it is an object of the present invention to provide an improved ink-jet print head which has a simple construction, but which is capable of suppressing the generation of air bubbles in the ink supply channel to prevent ejection problems from occurring.

In order to attain the above and other objects, the present invention provides an ink-jet print head comprising: an actuator formed with a plurality of ejection channels, the actuator having a predetermined surface, on which the plurality of ejection channels are opened to have their opened ends; a first wall, in confrontation with the predetermined surface, for defining an ink supply channel for supplying the liquid ink to the plurality of ejection channels through their opened ends; a second wall defining an inflow channel in fluid communication with the ink supply channel, the inflow channel being for supplying ink to the ink supply channel; and a sloped surface formed between the first wall and the second wall for defining an ink flow path for allowing ink to flow from the inflow channel to the ink supply channel, the sloped surface gradually increasing the cross-sectional area of the ink flow path in a direction toward the ink supply channel.

According to another aspect, the present invention provides an ink-jet print head comprising: an actuator formed with a plurality of ejection channels for accommodating a liquid ink and for ejecting drops of the liquid ink, the plurality of ejection channels being arranged in at least one row which extends in a predetermined direction, the actuator having a predetermined surface, on which each of the ejection channels is opened to have an inflow end for receiving the liquid ink flowing into the ejection channel; a manifold joined with the actuator on the predetermined surface, the manifold being formed with an ink supply channel which extends substantially along the predetermined direction in fluid communication with the inflow ends of the ejection channels to supply liquid ink to the ejection channels, the ink supply channel having a top portion which is located farthest away from the predetermined surface and which extends substantially along the predetermined direction, the top portion being located as shifted from a center of at least one ejection channel in a direction normal to the predetermined direction.

According to a further aspect, the present invention provides an ink-jet print head comprising: an actuator formed with a plurality of ejection channels for accommodating a liquid ink and for ejecting drops of the liquid ink, the ejection channels being arranged in at least one row which extends in a predetermined direction, the actuator having a predetermined surface, on which each of the ejection channels is opened to have an inflow end; a manifold joined with the actuator on the predetermined surface, the manifold being formed with an ink supply channel which extends along the at least one row of ejection channels for supplying liquid ink to each of the ejection channels, the manifold being further formed with an inflow channel connected to a first end of the ink supply channel to supply ink to the ink supply channel, the ink supply channel extending substantially in the predetermined direction between a first end and a second end opposite to the first end, the ejection channels in each of the at least one row being arranged so that their inflow ends are exposed in the ink supply channel between the first and second ends, the ink supply channel having a width along the predetermined surface, the width of the ink supply channel at its portion close to the second end decreasing toward the second end.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
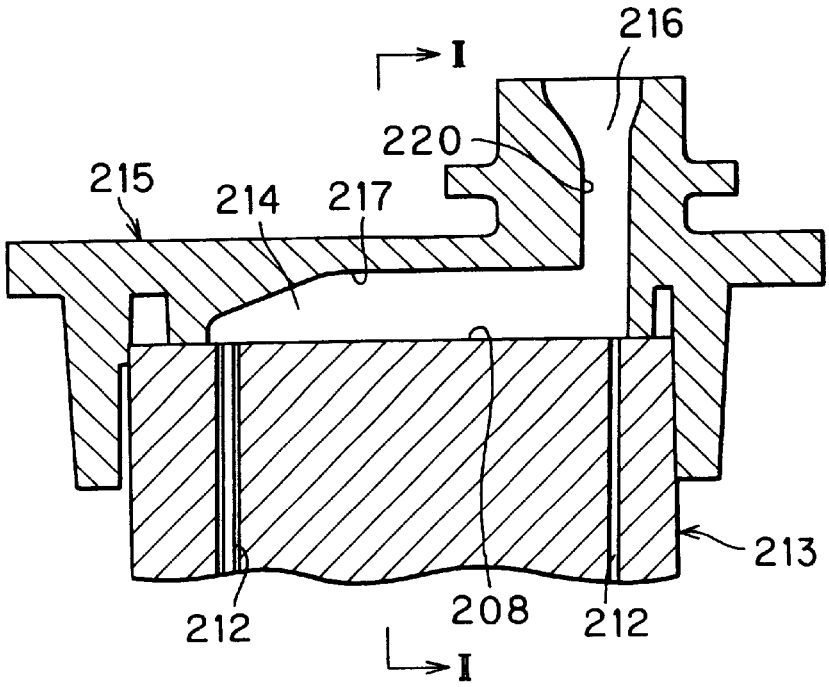
FIG. 1 is a side sectional view of a conceivable ink-jet print head.
Figure 2:
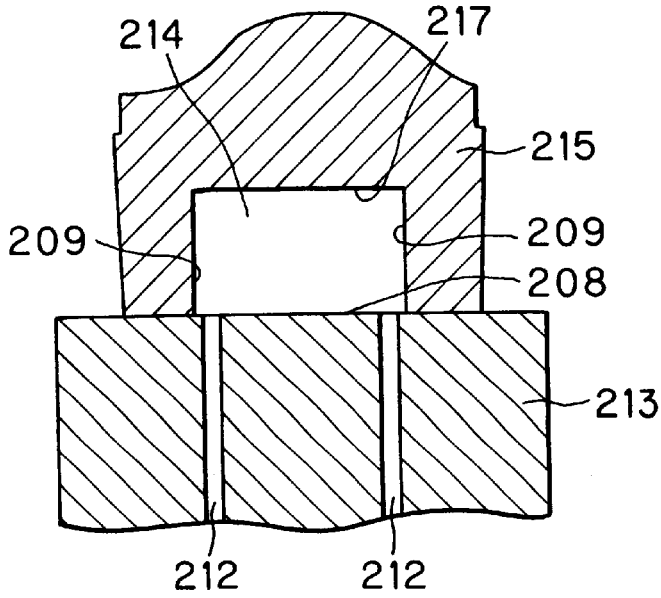
FIG. 2 is a cross-sectional side view of an essential part of the conceivable ink-jet print head taken along a line II—II in FIG. 1.

An ink jet print head according to preferred embodiments of the present invention will be described while referring to the accompanying drawings wherein like parts and components are designated by the same reference numerals to avoid duplicating description.

An ink jet print head according to a first preferred embodiment will be described below with reference to FIGS. 3 through 9.

Figure 3:
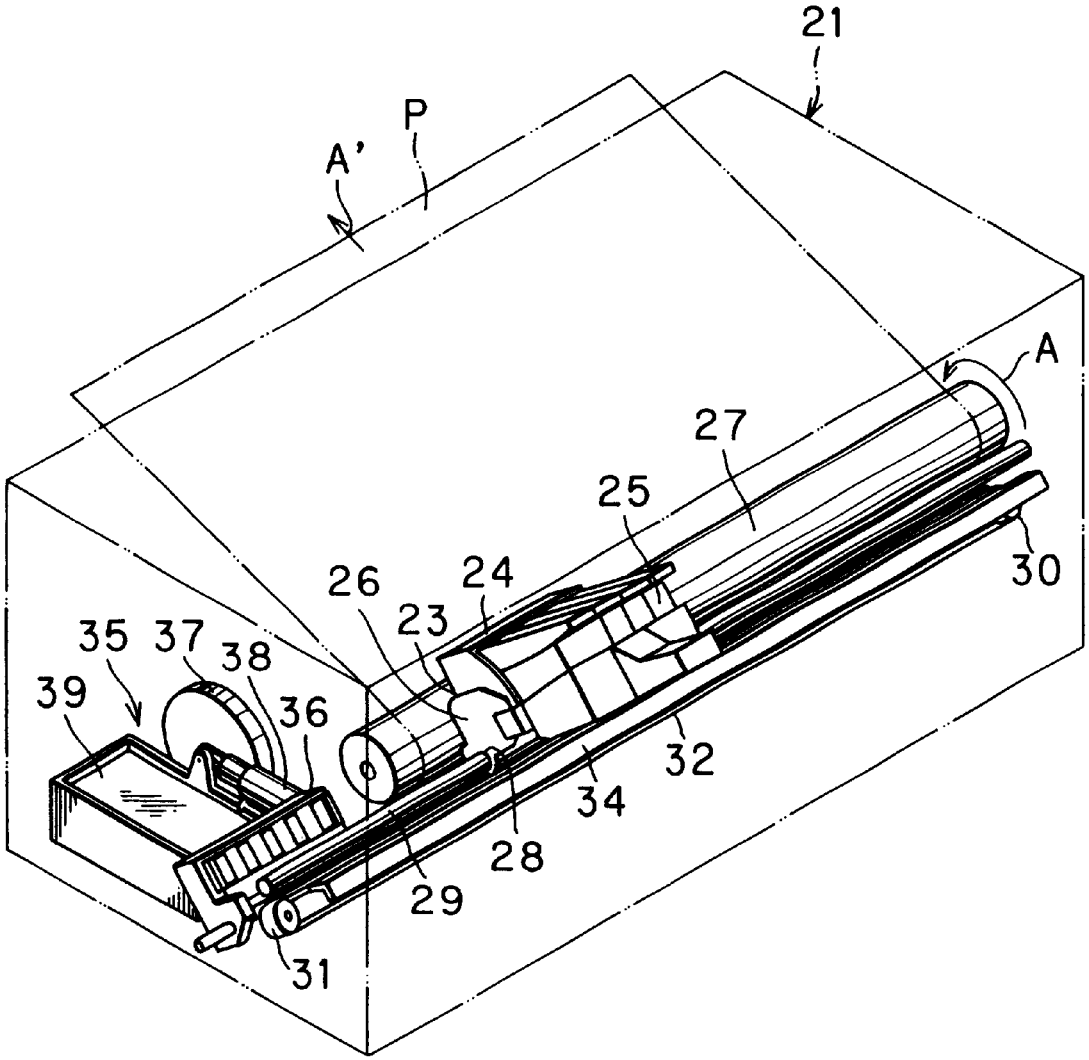
FIG. 3 is a perspective view of an ink-jet print device.

FIG. 3 shows a color ink-jet printer 21 of the first embodiment for printing color images on a printing paper P. The ink-jet printer 21 includes a paper supply cassette (not shown) for containing the printing papers P to be fed into the ink-jet printer 21; a platen roller 27 for guiding the printing paper P inward during the printing operation and expelling the printing paper P outward when the printing operation is completed; an ink-jet print head unit 24 for printing color ink on the printing paper P; a carriage 26 for supporting the ink-jet print head unit 24 near the platen roller 27 and for moving the ink-jet print head unit 24 in a direction parallel to the platen roller 27 during the printing process; and a purge device 35 disposed near to one end of the platen roller 27 for removing both air bubbles that have been collected in the ink-jet print head unit 24 and ink drops deposited on the outer ejection surface of the ink-jet print head unit 24.

The paper supply cassette (not shown) is disposed in the top surface on the back of the ink-jet printer 21 and contains a plurality of sheets of printing paper P. During a printing operation, one printing paper P is fed at a time into a printing section, where the ink-jet print head unit 24 is movably provided with respect to the platen roller 27. The platen roller 27 is freely rotatable and is disposed in opposition to the front surface of the ink-jet print head unit 24 and parallel to the transport path of the same. Here, the transport path indicates the path along which the ink-jet print head unit 24 is moved during printing operations. The ink-jet print head unit 24 will be described in more detail later.

During a printing operation, the printing paper P is guided between the ink-jet print head unit 24 and the platen roller 27, which is driven to rotate in a direction A indicated by an arrow in FIG. 3. The printing paper P is expelled from the ink-jet printer 21 in another direction A' indicated by another arrow in the figure after the printing operation is completed.

It is noted that the feeding mechanism for feeding the printing paper P has been omitted from the drawing.

The carriage 26 is provided for supporting the ink-jet print head unit 24 and four ink cartridges 25 at a predetermined declining angle. In order to support the carriage 26, a carriage shaft 29 is disposed parallel to and extending along the transport path of the ink-jet print head unit 24; and a guide plate 34 is disposed parallel to the carriage shaft 29. Thus, the carriage shaft 29 and the guide plate 34 extend along the platen roller 27. The carriage 26 is formed with a carriage shaft support portion 28 at its bottom portion. The carriage shaft 29 passes through the carriage shaft support portion 28. Hence, the carriage 26 is slidably supported at the predetermined declining angle on the carriage shaft 29 via the carriage shaft support portion 28 and on the guide plate 34. Further, pulleys 30 and 31 are disposed approximately one on each end of the carriage shaft 29. A belt 32 for moving the carriage 26 in the transport path parallel to the platen roller 27 is stretched around the pulleys 30 and 31, linking them together, and is attached to the carriage 26. A motor (not shown) is provided for driving the pulley 30, for example, to rotate, thereby moving the belt 32 and conveying the carriage 26 along the transport path.

The ink-jet print head unit 24 and the four ink cartridges 25 are detachably mounted on the carriage 26 and, therefore, can also be moved in the transport path parallel to the platen roller 27. Each of the ink cartridges 25 serves as an ink supply source for supplying ink to the ink-jet print head unit 24. The four ink cartridges 25 are for supplying four colors of ink, including cyan, magenta, yellow, and black. The ink-jet print head unit 24 is provided for printing images on the printing paper P in the above-described four colors. The print head unit 24 is constructed from four ink-jet print heads 23. Each ink-jet print head 23 is connected in fluid communication with a corresponding ink cartridge 25 when the ink-jet print head 23 and the corresponding ink cartridge 25 are mounted to the carriage 26. The print head unit 24 is mounted on the carriage 26 such that the ink-jet print head 23 ejects liquid ink at an angle slantedly downwardly onto the printing paper P.

In this way, the movement of the carriage 26 and the movement of the recording paper P cooperate to print desired images on the recording paper P through controlling the ink-jet print head unit 24 to eject ink on desired areas of the recording paper P.

The purge device 35 is disposed near to one end of the platen roller 27. The purge device 35 is positioned opposite to a reset position for each ink-jet print head 23. Here, the reset position indicates the position where the ink-jet print head 23 is located to be subjected to a purging operations. Each ink-jet print head 23 in the ink-jet print head unit 24 can sometimes develop problems in ejecting ink. These problems are usually caused by air bubbles generated in the print head 23 during an initial ink introduction timing or during other timings such as printing timings. These problems are also caused by ink drops deposited on the ejection surface of the print head 23. The purge device 35 is provided for removing, through suction, ink containing air bubbles in the ink-jet print head 23 and causing the ink-jet print head 23 to restore its good quality ejection condition.

In the purge device 35, a cap 36 is disposed in front of and opposing the reset position of the ink-jet print head 23. A pump 38 is provided to be driven by a cam 37 to develop a negative pressure, thereby sucking a predetermined amount of inferior ink, such as ink containing air bubbles, from the inside of the ink-jet print head 23. The inferior ink thus sucked from the ink-jet print head 23 is disposed in an ink disposal tank 39.

With the purge device 35 having the above-described structure, when the carriage 26 carries the ink-jet print head unit 24 so that one ink-jet print head 23, designed to be subjected to the purge operation, is brought into the reset position, the cap 36 covers the ink-jet print head 23. The pump 38 is driven by the cam 37 to remove, through suction, inferior ink from the inside of the ink-jet print head 23. The inferior ink is disposed in the disposal tank 39.

Each ink-jet print head 23, to be assembled into the ink-jet print head unit 24, will be described below in greater detail. Directional terms, such as up and down, will be used in the following description with reference to the state of the ink-jet print head 23 located in an orientation shown in FIG. 4A.

Figure 4A:
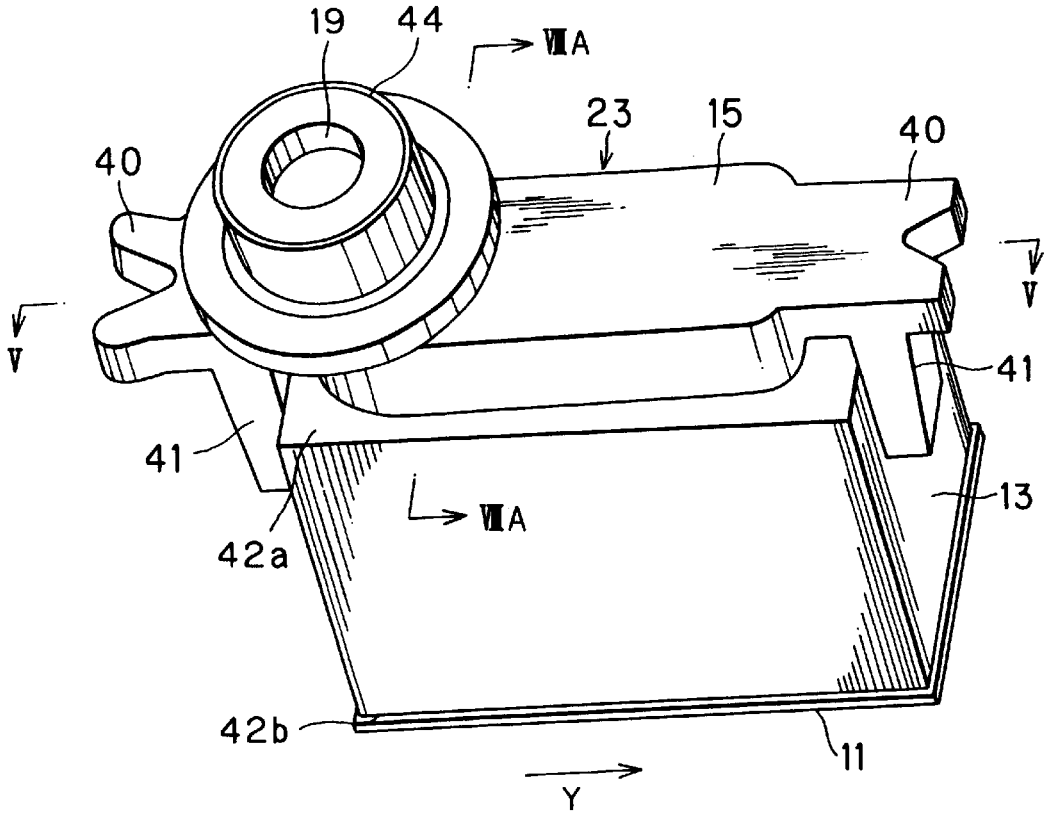
FIG. 4A is an upper external perspective view of an ink-jet print head, according to a first embodiment of the present invention, which is employed in the ink-jet print device of FIG. 3.

As shown in FIG. 4A, each ink-jet print head 23 includes: an actuator 13, a nozzle plate 11, and a manifold 15.

The actuator 13 will be described below. As shown in FIGS. 4A through 5, the actuator 13 has an upper end surface 42*a* and a lower end surface 42*b* opposed to the upper end surface 42*a*. The actuator 13 is formed with a plurality of ejection channels 12 in a plurality of (two, for example) rows. In each row, the plurality of ejection channels 12 are arranged in a straight line extending in a predetermined direction Y. It is noted that as shown in FIG. 4C, the plurality of ejection channels 12, in each row, includes a first end ejection channel 12*e*1 and a second end ejection channel 12*e*2 that are located in the opposite ends of the subject row. Each ejection channel 12 is opened at the upper end surface 42*a* for forming an inflow end 12*i* to receive ink flowing into the ejection channel 12. Each ejection channel 12 is also opened at the lower end surface 42*b* for forming an outflow end 12*o* to flow ink out of the ejection channel 12.

Figure 4B:
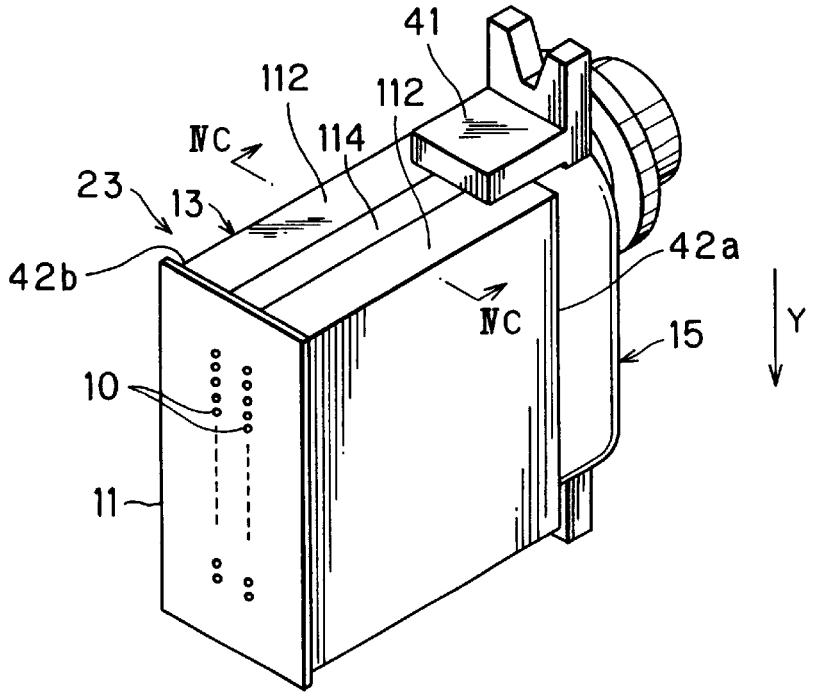
FIG. 4B is a lower external perspective view of the ink-jet print head of FIG. 4A.
Figure 4C:
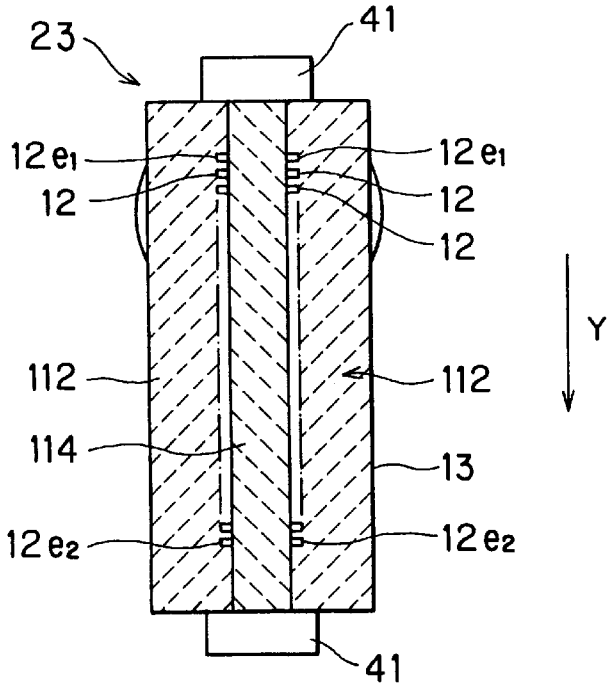
FIG. 4C is a cross-sectional view of the ink-jet print head take along a line IVC—IVC in FIG. 4B.
Figure 5:
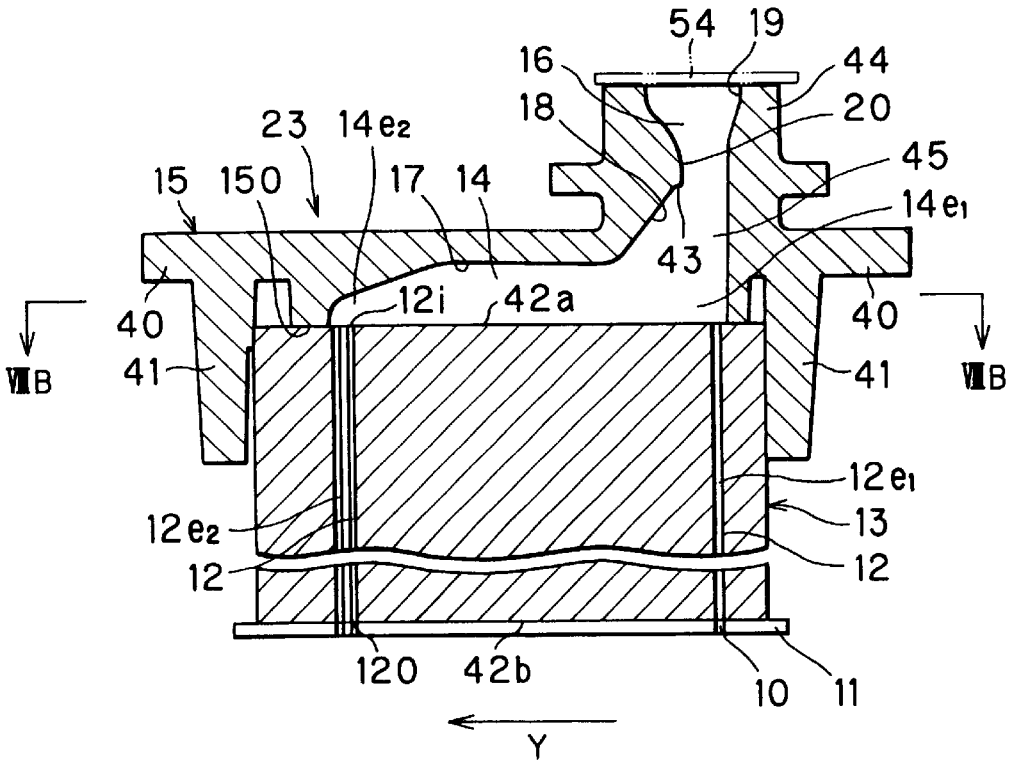
FIG. 5 is a side sectional view of the ink-jet print head taken along a line V—V in FIG. 4A.

More specifically, as shown in FIGS. 4B and 4C, the actuator 13 is constructed from a pair of base plates (outer side plates) 112 and a center plate 114 interposed between the pair of base plates 112. Each of the pair of base plates 112 is formed from a piezoelectric ceramic element. A plurality of grooves are formed in each base plate 112. The plurality of grooves are arranged in the predetermined direction Y and are separated from one another. The base plates 112 are joined to the center plate 114 on both opposite sides of the plate 114, respectively, thereby forming the plurality of channels 12 in two rows. Thus, the two rows of channels 12 are formed in the actuator 13, as interposed by the central plate 114.

As shown in FIGS. 4B and 5, the nozzle plate 11 is formed with a plurality of nozzle holes 10 arranged in a plurality of (two, in this example) rows. The nozzle plate 11 is attached to the lower end surface 42*b* of the actuator 13 so that the outflow end 12*o* of each ejection channel 12 connects to a corresponding nozzle hole 10 in the nozzle plate 11.

Next, the structure of the manifold 15 will be described.

Figure 6A:
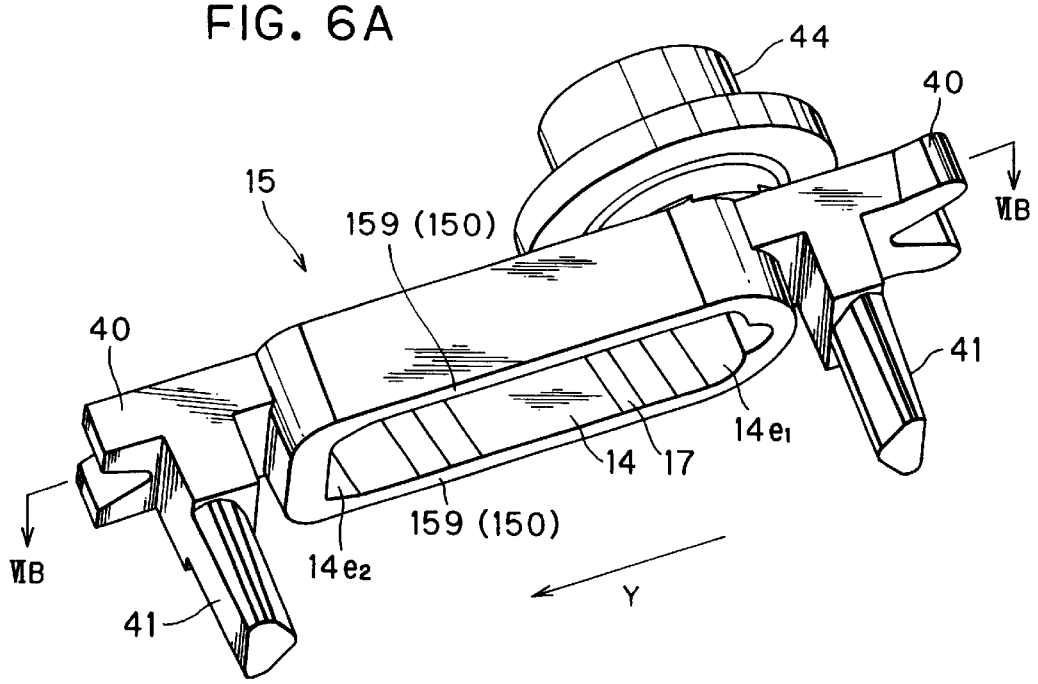
FIG. 6A is a perspective view of a manifold to be assembled to the ink-jet print head of the first embodiment.
Figure 6B:
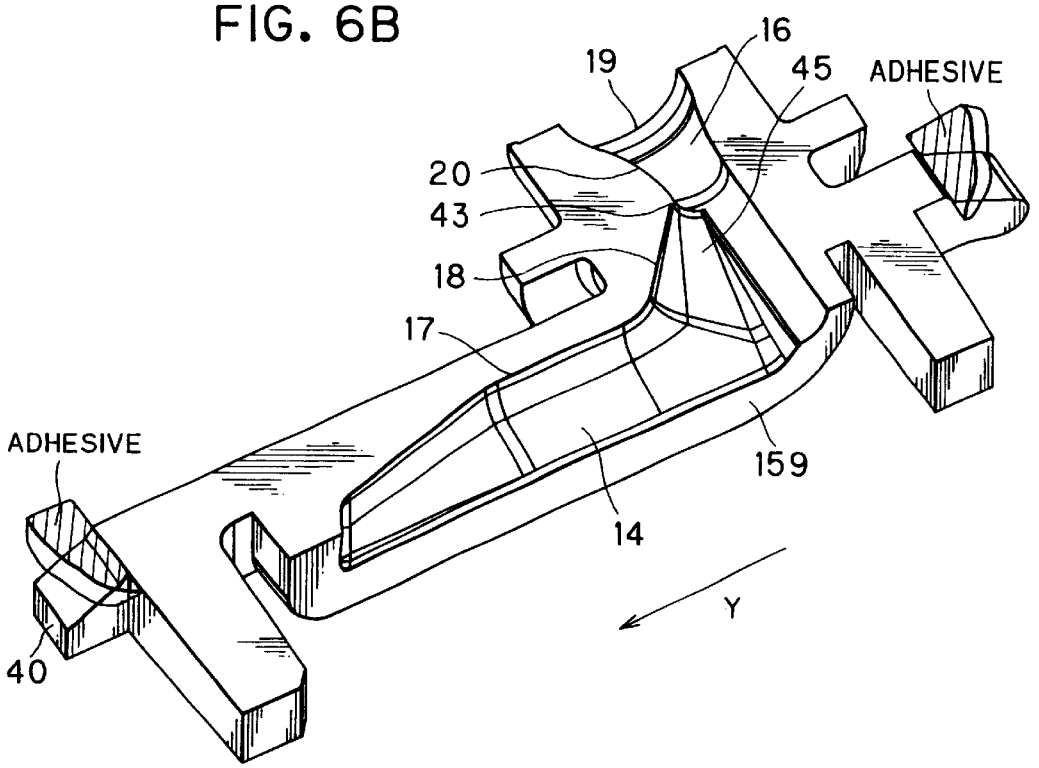
FIG. 6B is a side sectional view of the manifold of FIG. 6A taken along a line VIB—VIB.

As shown in FIGS. 5, 6A, and 6B, the manifold 15 is formed with an ink supply channel 14 for supplying liquid ink to the ejection channels 12. The ink supply channel 14 is opened at a lower end surface 150 of the manifold 15. More specifically, the lower end surface 150 of the manifold 15 is designed to have a pair of outside areas 159 and 159 for surrounding an opened end of the ink supply channel 14 therebetween. The manifold 15 is further formed with an inflow channel 16 and an ink flow path 45 in fluid communication with the ink supply channel 14. Ink entering the manifold 15 flows through the inflow channel 16 and the ink flow path 45 into the ink supply channel 14.

As shown in FIG. 4A, a mouth portion 44 is provided on an upper exterior surface of the manifold 15. An inflow opening 19 is formed through the mouth portion 44 in fluid communication with the inflow channel 16, providing a passage for supplying ink to the ink inflow channel 16 from an ink cartridge 25 (not shown) connected to the manifold 15.

Figure 7:
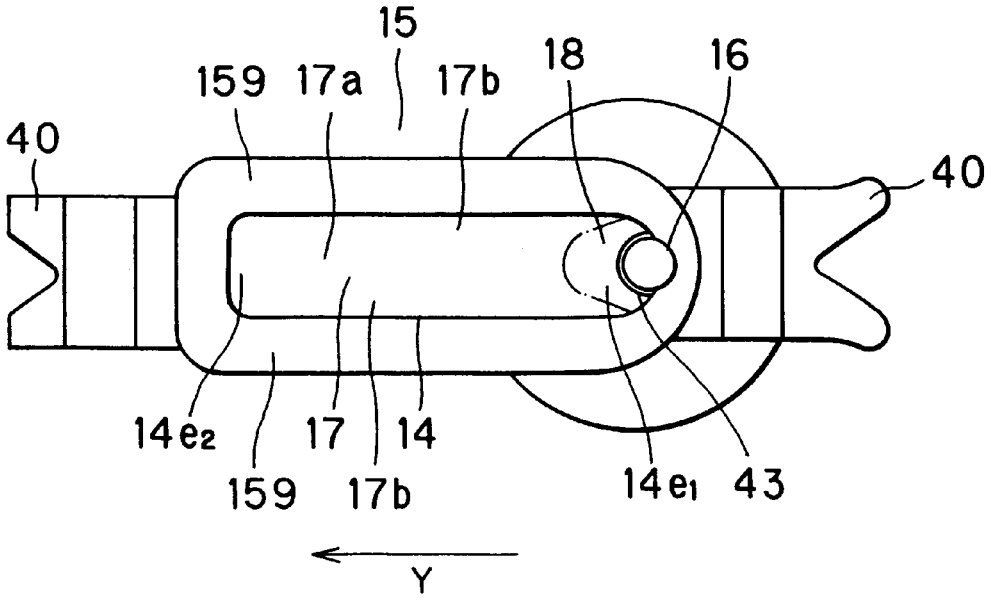
FIG. 7 is a bottom view of the manifold of FIG. 6A.

As shown in FIGS. 5 through 7, the ink supply channel 14 extends in the predetermined direction Y. More specifically, the ink supply channel 14 extends between its first end portion 14el and its second end portion 14*e*2, which are opposed to each other in the direction Y. The ink supply channel 14 is in fluid communication, at the first end portion 14*e*1, with the ink flow path 45. The second end portion 14*e*2 is located farthest away from the inflow channel 16.

Figure 8A:
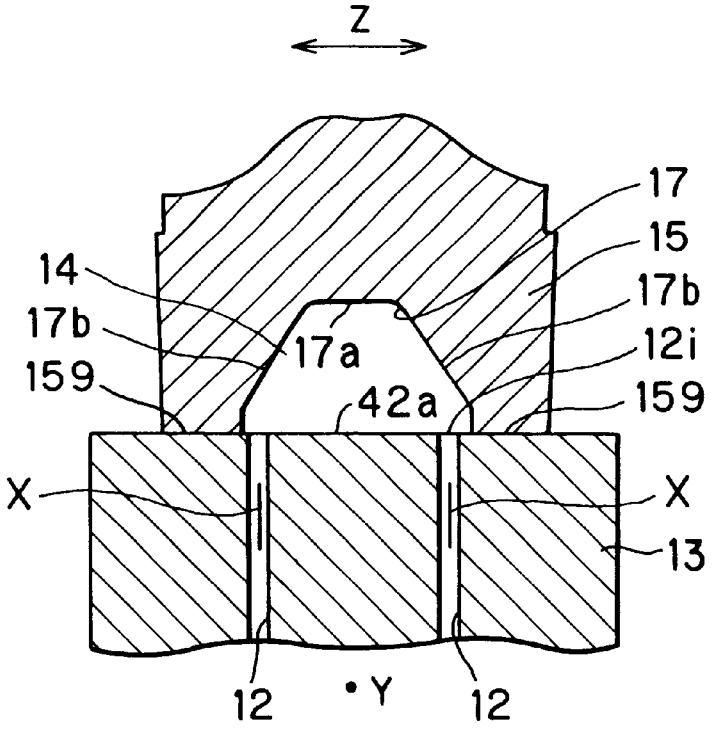
FIG. 8A is a cross-sectional side view of an essential part of the ink-jet print head of the first embodiment taken along a line VIIIA—VIIIA in FIG. 4A.

As shown in FIG. 8A, the manifold 15 is formed with an inner wall surface 17 defining the ink supply channel 14. The inner wall surface 17 includes: an upper horizontal wall surface (top wall surface) 17*a*: and a pair of side wall surfaces 17*b* extending slantedly downwardly from opposite side edges of the upper horizontal wall surface 17*a*. The upper horizontal wall surface 17*a* and the pair of side wall surfaces 17*b* extend along the predetermined direction Y between the first and second end portions 14*e*1 and 14*e*2 as shown in FIG. 7.

As shown in FIG. 8A, the upper horizontal inner wall surface 17*a* and the pair of side wall surfaces 17*b* are designed so that the ink supply channel 14 has substantially a U-shaped cross-section. That is, each side wall surface 17*b* extends slantedly upwardly from inner edges of the outer side area surfaces 159 of the manifold 15 so that the width of the ink supply channel 14 decreases toward the upper horizontal wall surface 17*a*. Thus, the inner wall surface 17 of the ink supply channel 14 is tapered toward its highest (top) portion 17*a*.

As shown in FIGS. 5, 6A, and 6B, the manifold 15 is further formed with an inner wall surface 20 defining the inflow channel 16. The manifold 15 is also formed with a sloped inner surface 18 located between the inner wall surface 20 and the inner wall surface 17. This sloped surface 18 defines the ink flow path 45 for supplying ink from the inflow channel 16 to the ink supply channel 14. The sloped surface 18 gradually increases the cross-sectional area of the ink flow path 45 in a direction toward the ink supply channel 14. As shown in FIGS. 5 and 7, the sloped surface 18 is slanted in a direction toward the second end portion 14*e*2 of the ink supply channel 14, which is disposed at an end portion farthest away from the inflow channel 16. A stepped portion (shelf portion) 43 is further provided on the upstream side of the sloped surface 18 for trapping air bubbles in the ink.

It is noted that the manifold 15 is further provided with a pair of mounting members 40 and 40 on both ends thereof. The pair of mounting members 40 and 40 are for ensuring that the ink-jet print head 23 is firmly attached to the carriage 26 as will be described later. The manifold 15 is also provided with a pair of mounting pieces 41 and 41 for fixedly securing the actuator 13 to the manifold 15.

The manifold 15 having the above-described structure is connected to the actuator 13 as described below.

Figure 8B:
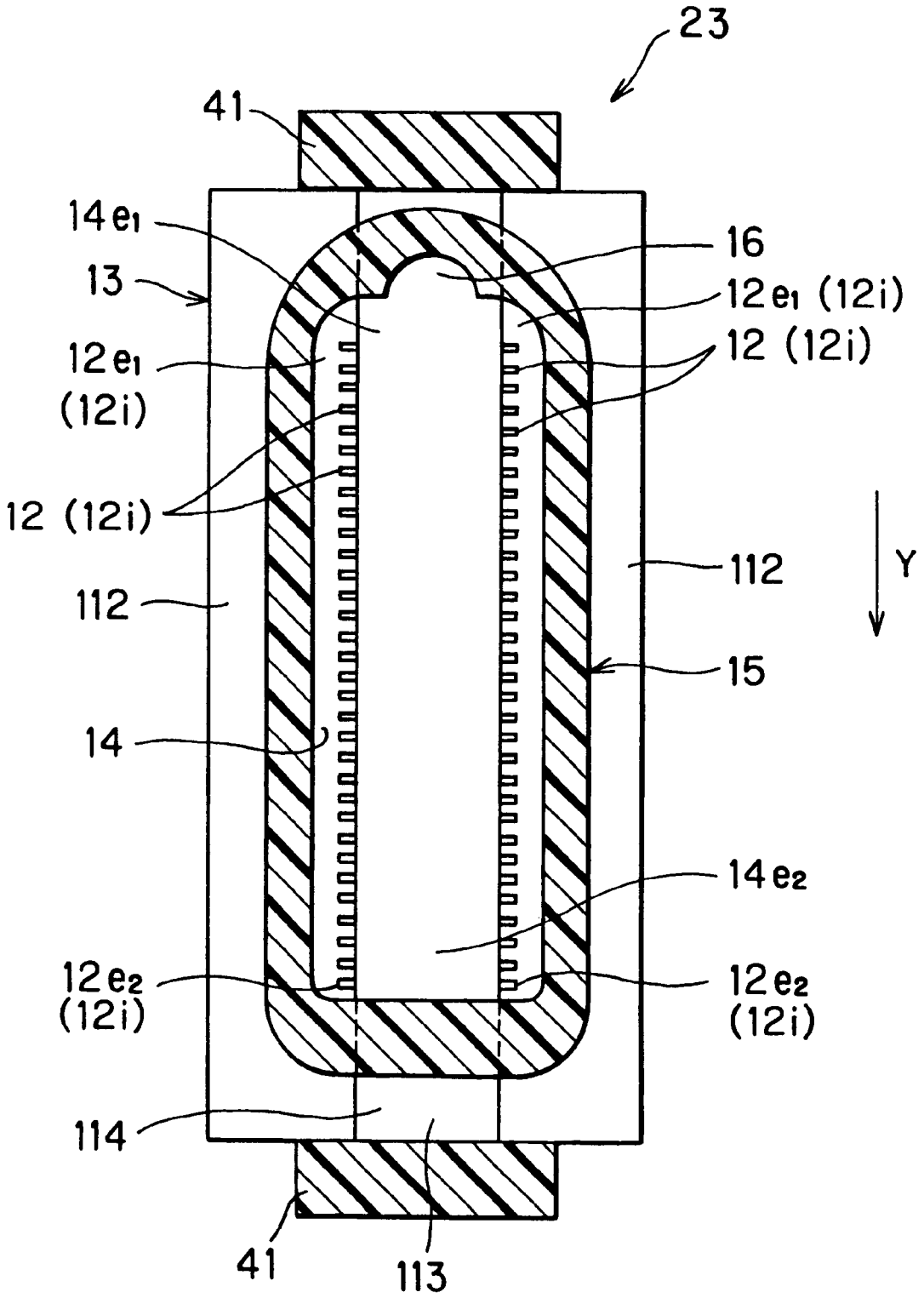
FIG. 8B is a cross-sectional view of the ink-jet print head of the first embodiment taken along a line VIIIB—VIIIB in FIG. 5.

The actuator 13, as connected to the nozzle plate 11, is sandwiched between these mounting pieces 41 and 41, and fixed in position by the mounting pieces 41 and 41 as shown in FIG. 4A. In this condition, the ink supply channel 14 extends along the two rows of ejection channels 12 as shown in FIG. 8B. The inflow ends 12*i* of all the ejection channels 12 in the two rows are exposed in the ink supply channel 14.

Then, an adhesive (not shown) is provided between the actuator 13 and the manifold 15. That is, an adhesive is provided between the outside area surfaces 159 of the manifold 15 and the upper end surface 42*a* of the actuator 13. As a result, the actuator 13 is sealingly and securely attached to the manifold 15. In this manner, the manifold 15 and the actuator 13, attached with the nozzle plate 11, are assembled together into an ink-jet print head 23.

When the manifold 15 is thus joined to the actuator 13, as shown in FIG. 8A, the upper horizontal wall surface 17*a* of the ink supply channel 14 faces the upper end surface 42*a* of the actuator 13 while being apart from the upper end surface 42*a* by a predetermined amount of distance. Thus, the ink supply channel 14 becomes properly surrounded by the inner wall 17 and the upper end surface 42*a*.

The inner wall 17 (the upper horizontal inner wall surface 17*a* and the side walls 17*b*) extends in the predetermined direction Y parallel to the rows of the ejection channels 12. The ink supply channel 14 is brought into fluid communication with the inflow openings 12*i* of all the ejection channels 12 in the two rows as shown in FIG. 8B. The ink supply channel 14 therefore serves to supply liquid ink from a connected ink cartridge 25 to each of the ejection channels 12 as will be described later.

As shown in FIG. 8A, in the ink supply channel 14, each side wall surface 17*b* extends slantedly upwardly from the upper surface 42*a* of the actuator 13 so that the width of the ink supply channel 14 decreases toward the upper horizontal wall surface 17*a*. In other words, each side wall surface 17*b* forms an acute angle with respect to the central axes X of the ejection channels 12. In addition, the upper horizontal inner wall surface 17*a* is located in a position offset from the central axes X of the ejection channels 12 at each row in a direction Z perpendicular to the predetermined direction Y and to the central axes X.

As shown in FIG. 8B, the ink supply channel 14 thus extends in the predetermined direction Y, along which the rows of the ejection channels 12 also extend. In each row, the first end ejection channel 12*e*1 becomes located nearest to the inflow channel 16. The second end ejection channel 12*e*2 is located farthest away from the inflow channel 16. The inflow end 12*i* of the first end ejection channel 12*e*1 is therefore exposed in the first end portion 14*e*1 of the ink supply channel 14. The inflow end 12*i* of the second end ejection channel 12*e*2 is exposed in the second end portion 14*e*2 of the ink supply channel 14. As shown in FIG. 5, the sloped surface 18 becomes slanted in a direction toward the second end ejection channel 12*e*2.

Figure 9:
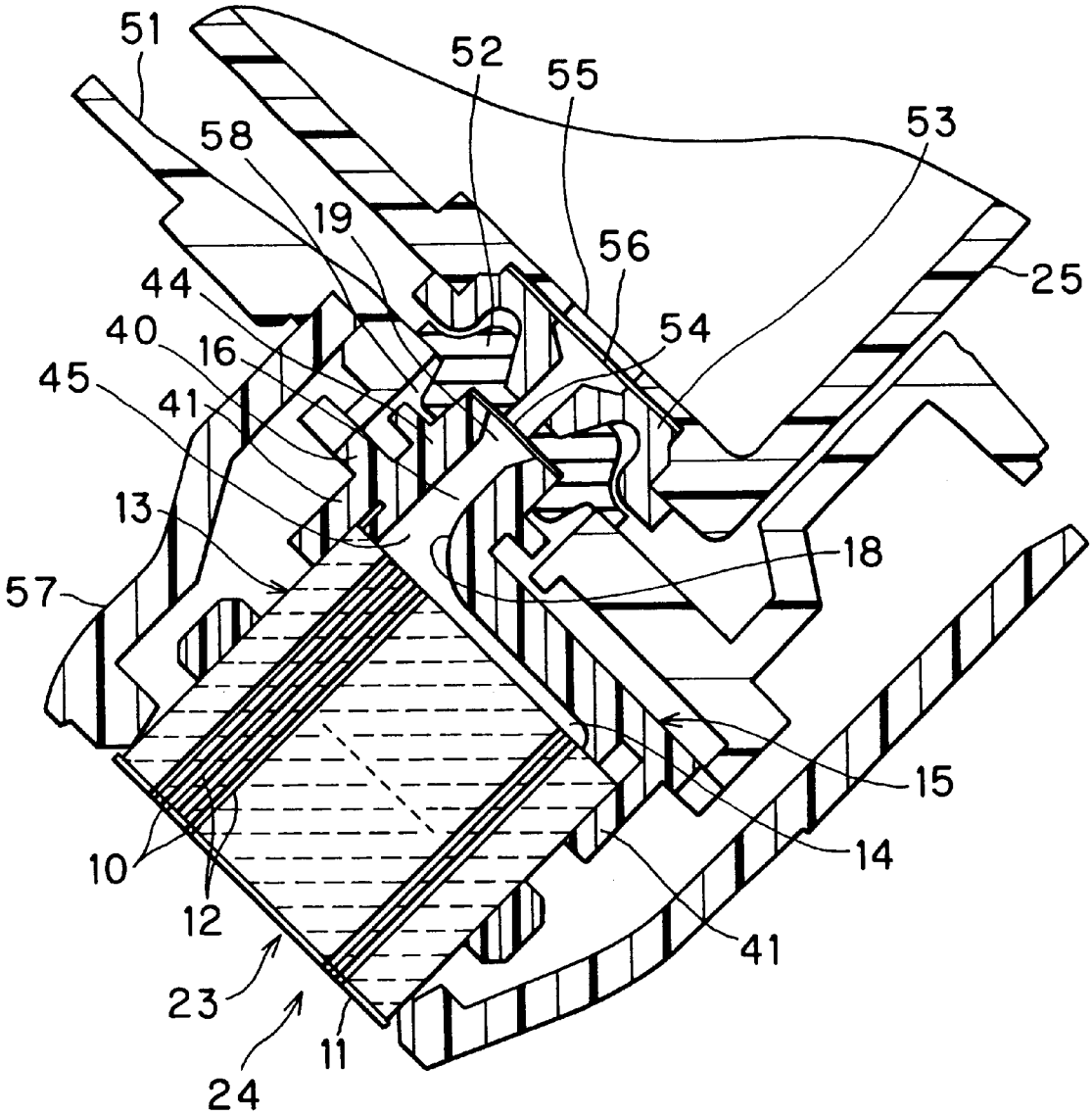
FIG. 9 is a side sectional view showing an ink-jet print head unit, mounted in the ink-jet print device of FIG. 3, the ink-jet print head of the first embodiment being mounted in the ink-jet print head unit.

Four ink-jet print heads 23, each being assembled as described above and as shown in FIG. 4A, are attached to a head unit wall 51, as shown in FIG. 9. The head unit wall 51 is a part of the carriage 26. As a result, the four ink-jet print heads 23 are united together into the ink-jet print head unit 24. Four ink cartridges 25 are also attached to the head unit wall 51 from an opposite side of the ink-jet print heads 23. Thus, the four ink cartridges 25 are connected to the respective ink-jet print heads 23 via the head unit wall 51. A head unit cover 57 is provided in connection with the head unit wall 51 for covering all the four ink-jet print heads 23 mounted to the head unit wall 51.

Each ink-jet print head 23 and the corresponding ink cartridge 25 are connected to the head unit wall 51 in a manner described below.

A through-hole 58 is formed to penetrate the head unit wall 51. The mouth portion 44 of the manifold 15 is inserted into this through-hole 58. The pair of mounting members 40 and 40 are attached via adhesive to the head unit wall 51 as shown in FIG. 6B. Thus, the manifold 15 is fixedly attached to the head unit wall 51. A rubber-made sealing member 52 is fitted into a gap between the mouth portion 44 and the through-hole 58. A first filter 54 is interposed between the sealing member 52 and the mouth portion 44 for preventing air bubbles and foreign matter from entering the ink supply channel 14 when the ink cartridge 25 is connected to the head unit vertical wall 51.

As shown in FIG. 9, each ink cartridge 25 is formed with an ink supply opening 55. A rubber-made adapter 53 is fitted into the ink supply opening 55 for connecting the ink cartridge 25 to the sealing member 52. A second filter 56 is interposed between the ink supply opening 55 and the adapter 53 for preventing liquid ink from flowing out of the ink supply opening 55 when the ink cartridge 25 is connected to the ink-jet print head 23. The liquid ink is prevented from spilling out through the ink supply opening 55 by the surface tension of the ink established on the second filter 56.

The ink cartridge 25 is detachably connected to the manifold 15 through fitting the adapter 53 into the sealing member 52. As a result, the inside of the ink cartridge 25 is brought into fluid communication with the inflow channel 16 via the ink supply opening 55 and the inflow opening 19. The liquid ink stored in the inside of the ink cartridge 25 is introduced into the inflow opening 19 from the ink supply opening 55 via the adapter 53 and the sealing member 52.

When the ink-jet print head 23 and the ink cartridge 25 are thus mounted to the head unit wall 51, the ink-jet print head 23 and the ink cartridge 25 are disposed at a downward slant of about 45 degrees, for example, as shown in FIG. 9. Accordingly, the nozzle plate 11 is disposed facing slantedly downward, and the manifold 15 is disposed above the nozzle plate 11 via the actuator 13.

In this posture of the ink-jet print head 23 and the ink cartridge 25, liquid ink from the ink cartridge 25 flows into the manifold 15 via the inflow opening 19. Ink flows through the inflow channel 16 and the ink flow path 45, before flowing into the ink supply channel 14. The ink is then supplied to each channel 12 of the actuator 13.

When the piezoelectric ceramic in the actuator 13 is partially applied with electric field, the piezoelectric ceramic is partially transformed. This transformations in the actuator 13 causes changes in the volumes of ejection channels 12 desired to be actuated. When the volumes of the ejection channels 12 are decreased, the liquid ink in those channels 12 is ejected in droplets in a slanted downward direction from the nozzle holes 10 and onto the printing paper P. When the volumes of the ejection channels 12 are increased, on the other hand, ink from the ink cartridge 25 is introduced into the ejection channels 12 via the inflow opening 19, the inflow channel 16, the ink flow path 45, and the ink supply channel 14.

Because the ink-jet print head 23 is disposed as shown in FIG. 9 at a downward slant of about 45 degrees, the inflow channel 16 is disposed above the ink supply channel 14 and is in fluid communication with the ink supply channel 14. Accordingly, ink smoothly flows downwardly from the inflow channel 16 to the ink supply channel 14. It is noted, however, that the ink-jet print head 23 can be disposed so that the nozzle plate 11 will confront in a horizontal direction or a vertical direction. When the ink-jet print head 23 is disposed so that the nozzle plate 11 will confront in the horizontal direction, the ink-jet print head 23 is preferably disposed so that the inflow channel 16 is disposed above the ink supply channel 14.

According to the present embodiment, the sloped surface 18 is formed to provide the ink flow path 45 between the inflow channel 16 and the ink supply channel 14. Accordingly, when ink is supplied from the inflow channel 16 to the ink flow path 45, ink flows along the sloped surface 18 into the ink supply channel 14. Because the cross-sectional area of the ink flow path 45 gradually increases due to the sloped surface 18, the rate of flow in the ink gradually decreases. Hence, the liquid ink flows more gently into the ink supply channel 14. Accordingly, ink does not forcibly hit the upper end surface 42*a* of the actuator 13 and does not generate air bubbles. Hence, generation of air bubbles in the ink supply channel 14 can be effectively restrained to prevent ejection problems from occurring.

As shown in FIG. 5, the sloped surface 18 is slanted in the direction toward the inflow ends 12*i* of the second end ejection channels 12*e*2 that are disposed farthest away from the inflow channel 16. By sloping the sloped surface 18 in this manner, the ink flowing from the inflow channel 16 into the ink supply channel 14 flows and spreads along the sloped surface 18 toward the second end ejection channels 12*e*2. As a result, ink can be smoothly supplied even to the farthest end-located ejection channels 12*e*2 without generating air bubbles.

The stepped portion 43 is provided on the upstream side of the sloped surface 18 for trapping air bubbles in the ink. As indicated in FIG. 5 with a broken line, the filter 54 is disposed at the entrance 19 to the inflow channel 16 in order to prevent foreign matter from entering the ink supply channel 14. However, fine air bubbles generated in ink in the ink supply channel 14 can migrate to this filter 54 and accumulate. Such air bubbles that accumulate and become deposited on the filter 54 will form a meniscus in the minute openings of the filter 54, and can hinder the flow of ink. However, the shelf portion 43 provided on the sloped surface 18 can trap these air bubbles attempting to migrate to the entrance 19 of the inflow channel 16. Accordingly, the air bubbles can be prevented from accumulating around the filter 54 and blocking the flow of ink. Further, air bubbles trapped on the shelf portion 43 can be easily moved by the ink flow, unlike those ink bubbles that form a meniscus in the minute openings of the filter 54. Accordingly, the air bubbles can be easily moved by the ink flow resulting from ink ejection, thereby avoiding ejection problems.

As shown in FIG. 8A, the inner wall surface 17 is designed so that the ink supply channel 14 has substantially a U-shaped cross-section. With this structure, it is possible to cause air bubbles to accumulate on the highest upper wall portion (top wall portion) 17*a*, in the U-shaped cross-sectional channel 14, which is separated away from the upper end surface 42*a* where the ejection channels 12 are opened. Accordingly, air bubbles will not likely be drawn into the ejection channels 12, and ejection problems can be prevented.

In addition, the highest portion 17*a* in the channel 14 is in a position offset from the imaginary centerlines (central axes) X passing through the ejection channels 12. The left and right side walls 17*b* of the inner wall 17 form acute angles with respect to the central axes X of the ejection channels 12 and taper toward the highest portion 17*a*. The highest portion 17*a* extends parallel to the rows of the ejection channels 12. By forming this highest portion 17*a* in such a position as offset from the imaginary lines X passing through the ejection channels 12, the air bubbles accumulating on the highest portion 17*a* will be in a position shifted from the ejection channels 12 in the direction Z normal to the rows of ejection channels 12 (Y direction) and to the central axes X of the ejection channels 12. Accordingly, the air bubbles will not likely be drawn into the ejection channels 12, and ejection problems can be effectively prevented.

A second embodiment of the present invention will be described below with reference to FIGS. 10 through 21.

Figure 10:
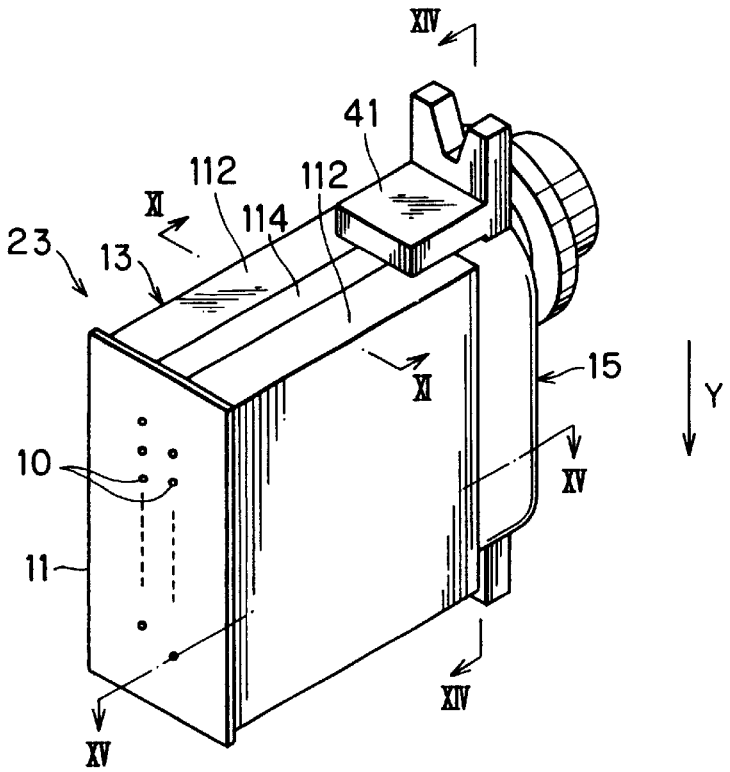
FIG. 10 is a lower external perspective view of an ink-jet print head, according to a second embodiment of the present invention, which is employed in the ink-jet print device of FIG. 3.

The ink-jet print head 23 of the present embodiment has the same external view as that of the first embodiment as shown in FIG. 10. Similarly to the first embodiment, the ink-jet print head 23 of the present embodiment includes the actuator 13, the nozzle plate 11, and the manifold 15.

Figure 11:
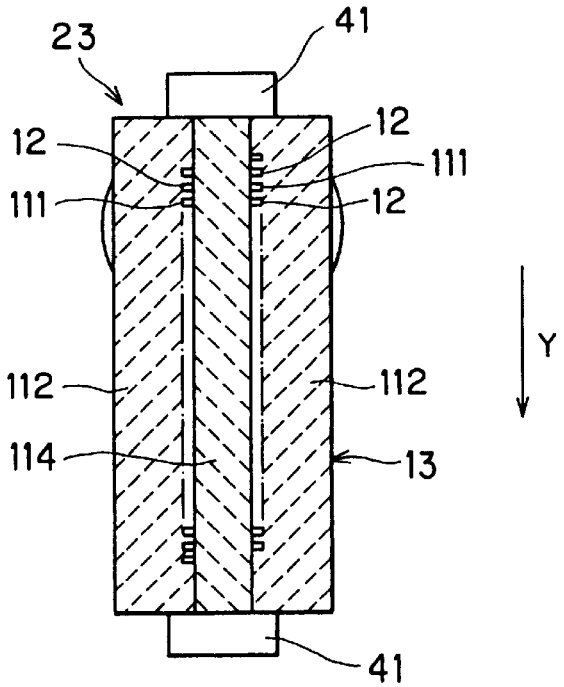
FIG. 11 is a cross-sectional view of the ink-jet print head of the second embodiment taken along a line XI—XI in FIG. 10.

The actuator 13 of the present embodiment has almost the same structure as that of the first embodiment. That is, as shown in FIGS. 10 and 11, the actuator 14 of the present embodiment is constructed from the pair of base plates 112 and the center plate 114 in the same manner as in the first embodiment. In each base plate 112, the plurality of grooves are arranged in the predetermined direction Y and are separated from one another. The base plates 112 are joined to the center plate 114 on both opposite sides of the plate 114, respectively, thereby forming a plurality of channels in two rows. Thus, the two rows of channels are formed in the actuator 13, as interposed by the central plate 114.

Figure 15:
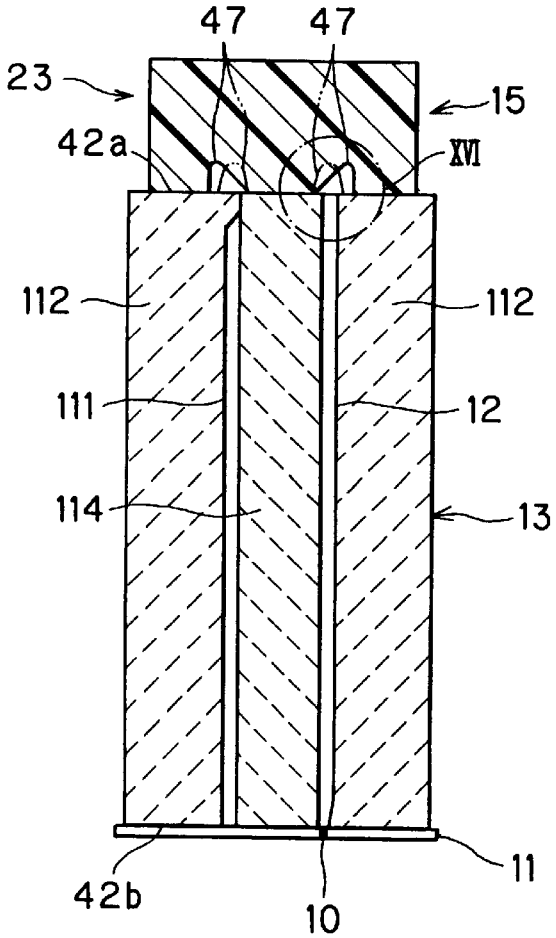
FIG. 15 is a cross-sectional side view of the ink-jet print head of the second embodiment taken along a line XV—XV in FIG. 10.
Figure 14:
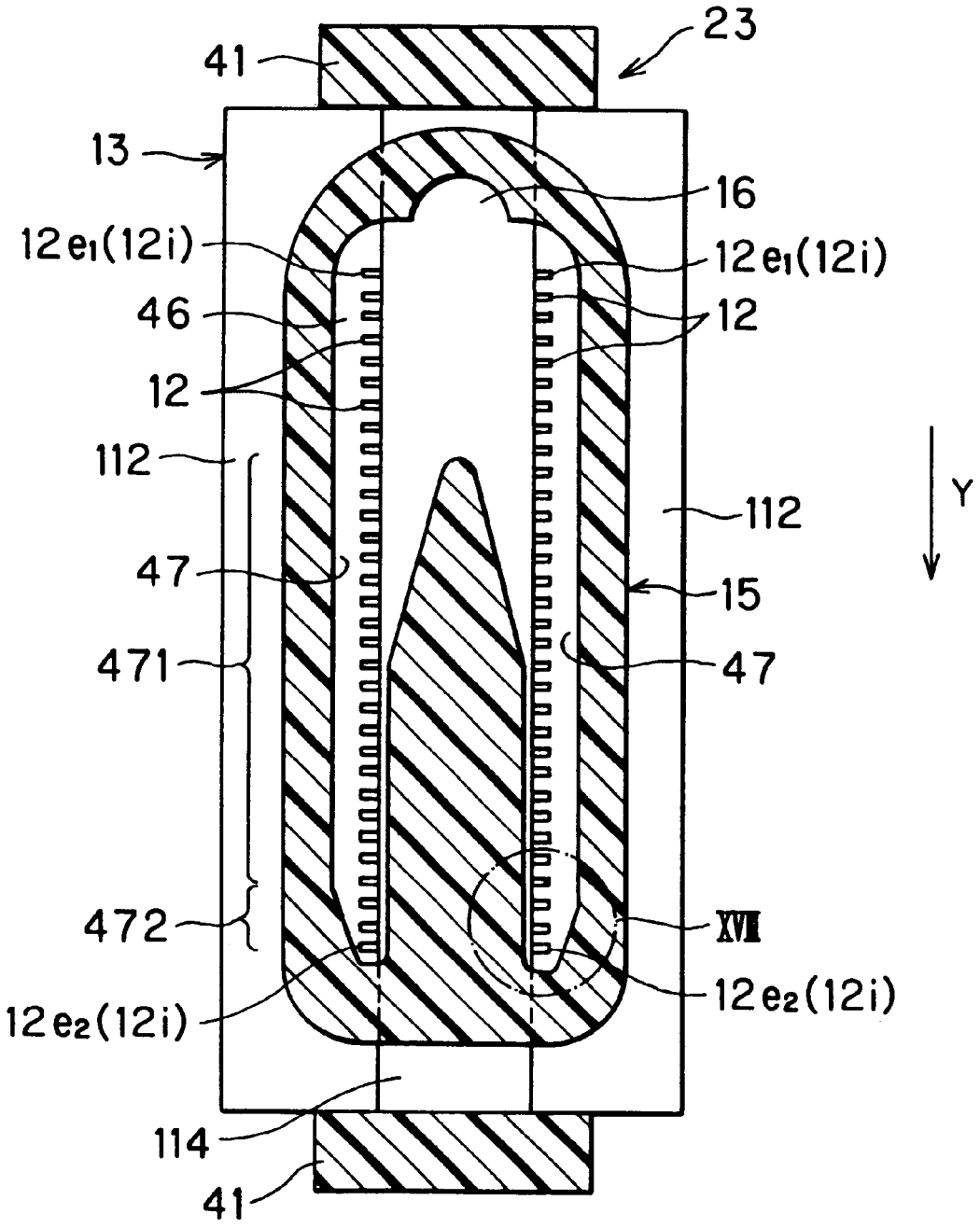
FIG. 14 is a cross-sectional view of the ink-jet print head of the second embodiment taken along a line XIV—XIV in FIG. 10.
Figure 21:
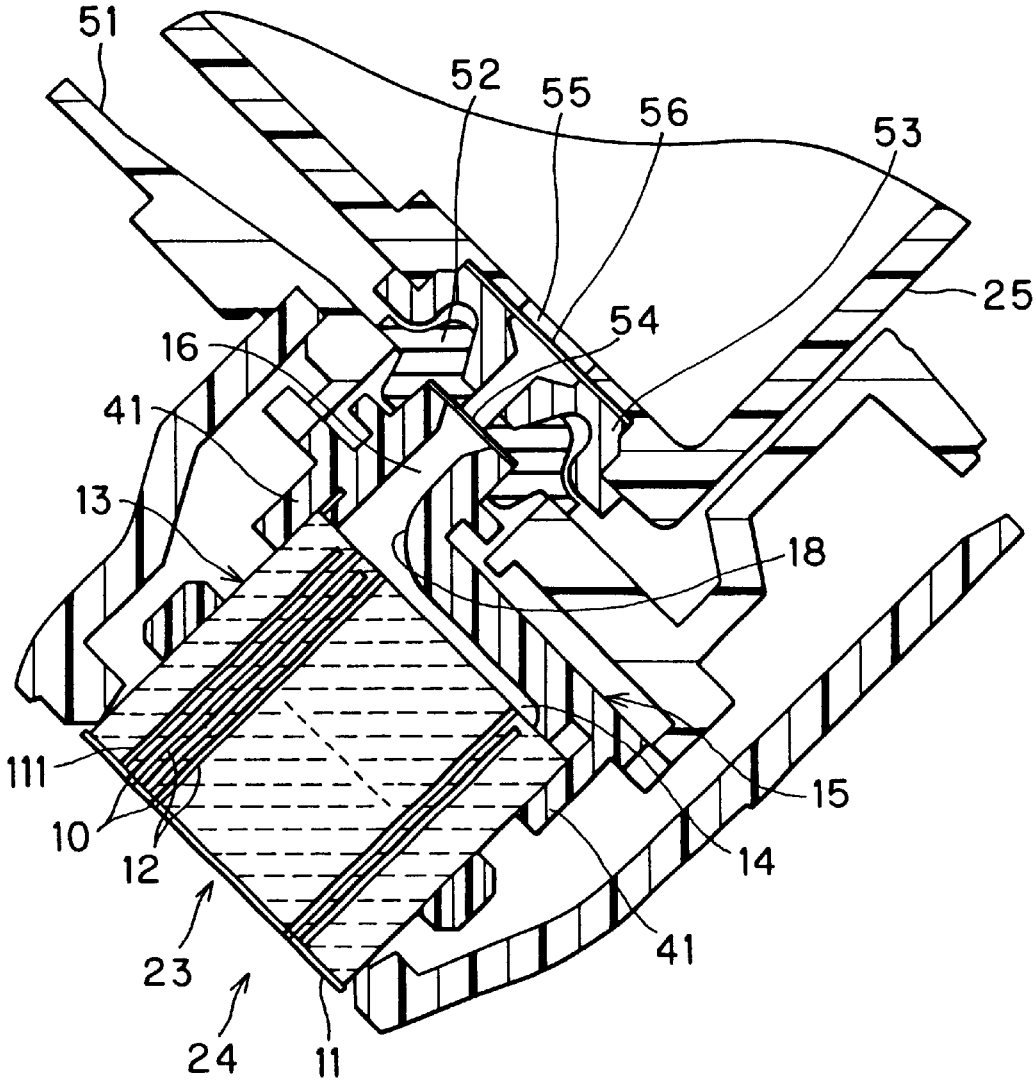
FIG. 21 is a side sectional view showing an ink-jet print head unit, mounted in the ink-jet print device of FIG. 3, the ink-jet print head of the second embodiment being mounted in the ink-jet print head unit.

According to the present embodiment, however, as shown in FIGS. 11 and 21, the thus produced channels include not only the ejection channels 12 but also dummy channels 111. The dummy channels 111 are provided in order to facilitate volume changes in the respective ejection channels 12. Each dummy channel 111 is provided parallel to and between two neighboring ejection channels 12. In other words, the ejection channels 12 and the dummy channels 111 are arranged in alternation in each row. As apparent from FIG. 11, the ejection channels 12 are arranged in a staggered manner entirely over the two rows, and the dummy channels 111 are arranged also in a staggered manner over the two rows. It is noted that as shown in FIGS. 15 and 21, each dummy channel 111 is closed on the upper end surface 42*a* of the actuator 13 to prevent ink from entering therein, while each normal ejection channel 12 is opened on the upper end surface 42*a*. Accordingly, the inflow ends 12*i* of all the ejection channels 12 are arranged in two rows as shown in FIG. 14. In each row, the inflow ends 12*i* are successively arranged in the predetermined direction Y from the inflow end 12*i* of the first end ejection channel 12*e*1 toward the inflow end 12*i* of the second end ejection channel 12*e*2. As shown in FIG. 15, both of the ejection channels 12 and the dummy channels 111 are opened on the lower end surface 42*b* of the actuator 13.

As shown in FIGS. 10 and 15, the nozzle plate 11 of the present embodiment is formed with two rows of nozzles 10 so that the nozzles 10 are arranged as staggered manner in correspondence with the ejection channels 12.

The structure of the manifold 15 of the present embodiment is the same as that of the first embodiment except for the shape of the ink supply channel 14.

Figure 12A:
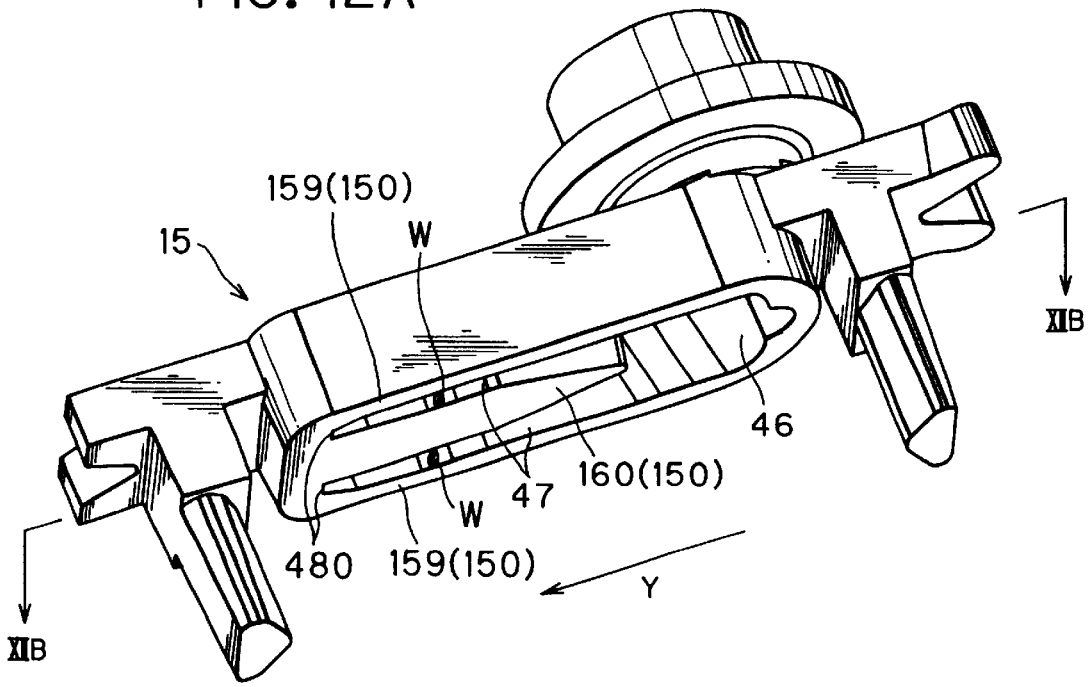
FIG. 12A is a perspective view of a manifold to be assembled to the ink-jet print head of the second embodiment.
Figure 12B:
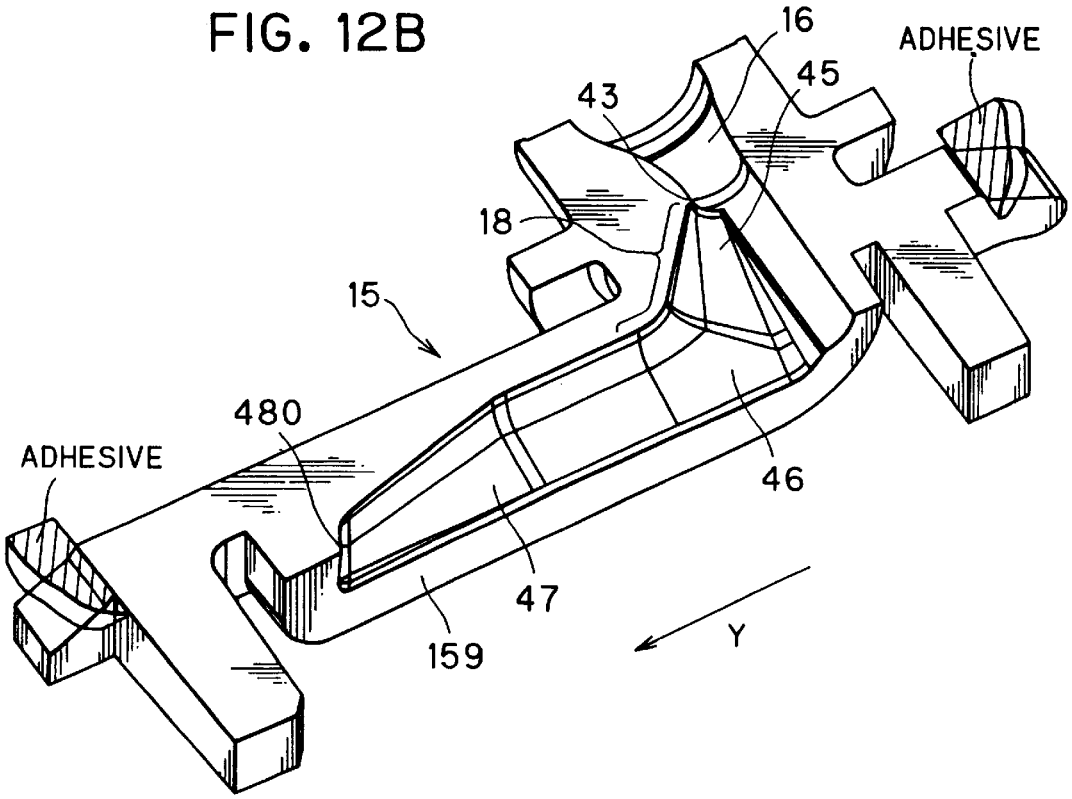
FIG. 12B is a side sectional view of the manifold of FIG. 12A take along a line XIIB—XIIB.
Figure 13:
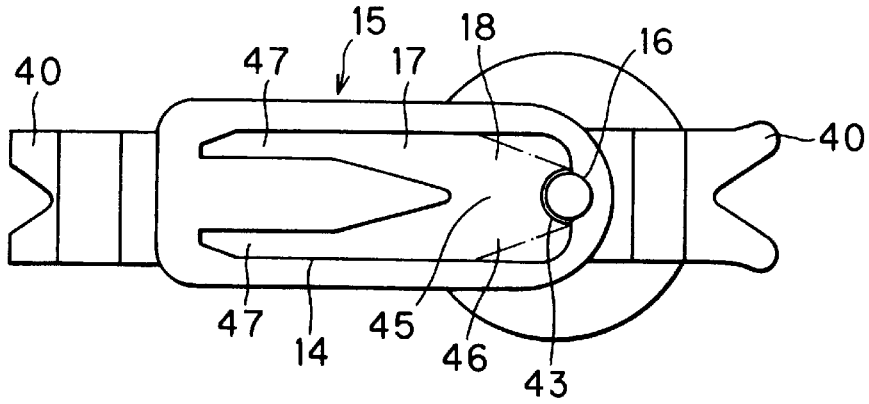
FIG. 13 is a bottom view of the manifold of FIG. 12A.

According to the present embodiment, the ink supply channel 14 is designed as shown in FIGS. 12A, 12B, and 13. That is, the ink supply channel 14 is shaped to include a base channel portion 46 and two branch channel portions 47 and 47. In other words, the ink supply channel 14 forks into the two branch channel portions 47 and 47. The two branch channel portions 47 and 47 have the same shape with each other. The base channel portion 46 and the branch channel portions 47 are opened on the lower end surface 150 of the manifold 15. Thus, the lower end surface 150 includes: the pair of outside surface areas 159 sandwiching therebetween the opened ends of the channel portions 46 and 47; and a central surface area 160 sandwiched between the channel portions 47. The ink supply channel 14 is in fluid communication with the ink flow path 45 at the base channel portion 46. Each ink branch channel portion 47 extends along the predetermined direction Y toward an inner end wall 480 of the manifold 15.

As shown in FIGS. 12B and 13, according to the present embodiment, the sloped surface 18 is provided to extend further across the base channel portion 46 to be widened in a direction toward the branch channel portions 47.

The manifold 15 is attached to the actuator 13, as connected to the nozzle plate 11, in the same manner as in the first embodiment. That is, the manifold 15 is attached to the actuator 13 so that the ink supply channel 14 extends along the rows of ejection channels 12 and is opened over the inflow ends 12*i* of all the ejection channels 12. As a result, all the ejection channels 12 are exposed in the ink supply channel 14 as shown in FIG. 14. The first end ejection channel 12*e*1 in each row becomes located nearest to the ink flow channel 16. The second end ejection channel 12*e*2 becomes located farthest away from the ink flow channel 16. Several ejection channels 12, arranged successively from the first end ejection channel 12*e*1 in each of the two rows, are located in fluid communication with the base channel portion 46. Other remaining channels 12, including the second end ejection channel 12*e*2, in each row are located in fluid communication with the corresponding branch channel portion 47. Thus, the base channel portion 46 is brought into fluid communication with the several ejection channels 12 in the two rows in common. The branch channel portions 47 are brought into fluid communication with remaining ejection channels 12 in the respective rows. With this structure, liquid ink can flow from the inflow channel 16 through the ink flow path 45 into the base channel portion 46 and further down both branch channel portions 47. Thus, ink is introduced into all the ejection channels 13 in each row.

The ink-jet print head 23 thus fabricated as shown in FIG. 10 is attached to the carriage wall 51 and mounted in the printing device 21 as shown in FIG. 21 in the same manner as in the first embodiment.

According to the present embodiment, the ink supply channel 14 is divided into the base channel portion 46 and the two branch channel portions 47. Accordingly, it is possible to decrease the entire volume of the ink supply channel 14 as compared with the first embodiment.

Because the sloped surface 18 is provided to gradually increase the cross-sectional area of the ink flow path 45 and to extend over the base channel portion 46 to widely spread into the both branch portions 47. Ink flows from the inflow channel 16 along the sloped surface 18 into each of the branch channel portions 47. Accordingly, ink can be smoothly supplied to the ejection channels 12 in both rows. It is possible to effectively suppress the accumulation of air bubbles in the ink supply channel 14 when ink is initially introduced into the same.

Especially, according to the present embodiment, each branch channel portion 47 is designed as described below.

Figure 18:
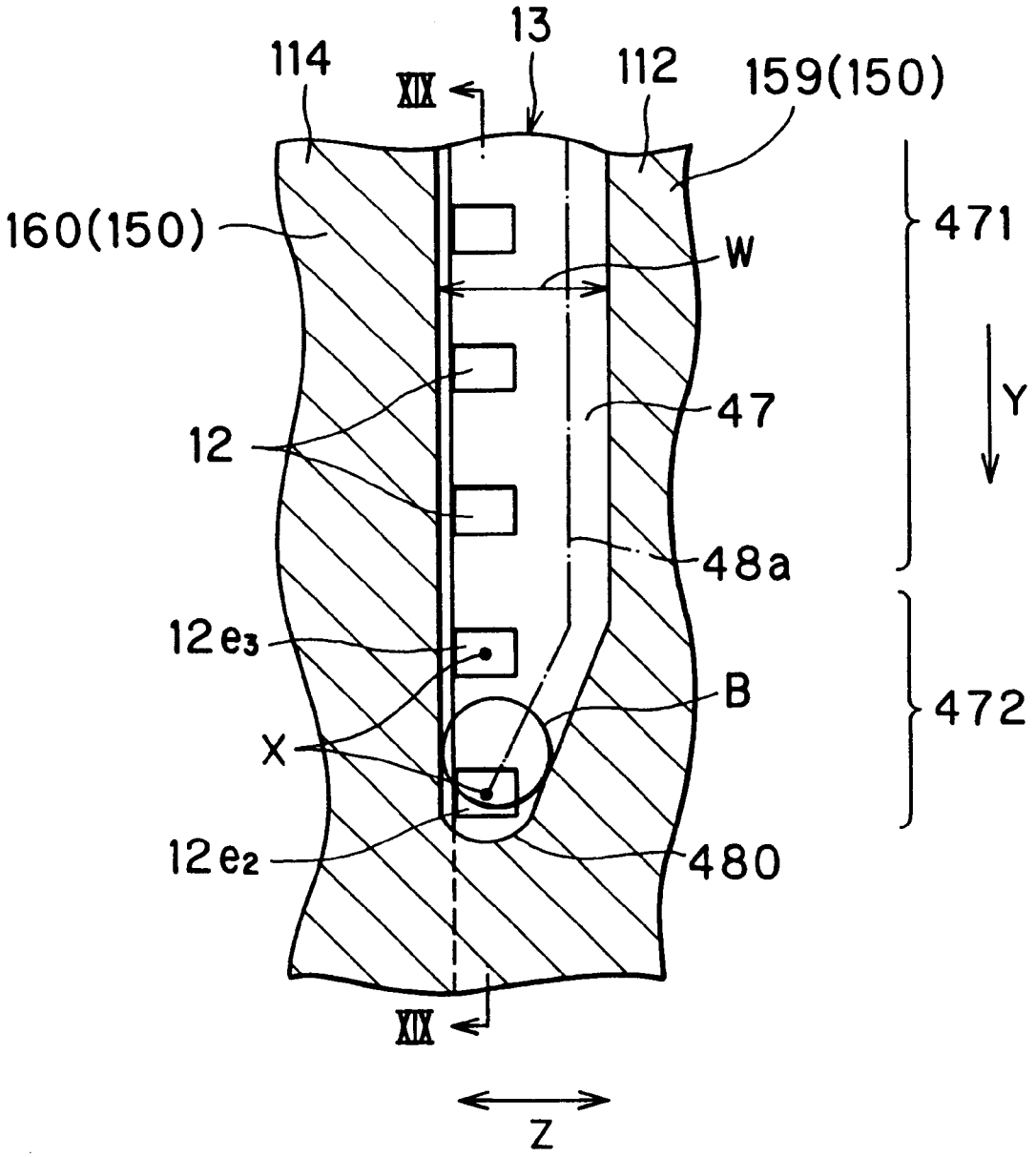
FIG. 18 is an enlarged cross-sectional view of a portion XVIII in FIG. 14, where a part of the surface of the manifold connected to the actuator is shown.

As shown in FIGS. 14 and 18, each branch channel portion 47 has a first area 471 and a second area 472 arranged in the channel portion extending direction Y. The first area 471 of the branch channel portion 47 is connected to the base channel portion 46, and the second area 472 extends toward the end wall surface 480 of the branch channel portion 47. A width W of the branch channel portion 47, which is defined on the lower end surface 150 of the manifold 15 between the inner edges of the central area 160 and the outer side area 159, is unchanged in the first area 471. In the second area 471, however, the width W gradually decreases toward the end wall 480.

Figure 16:
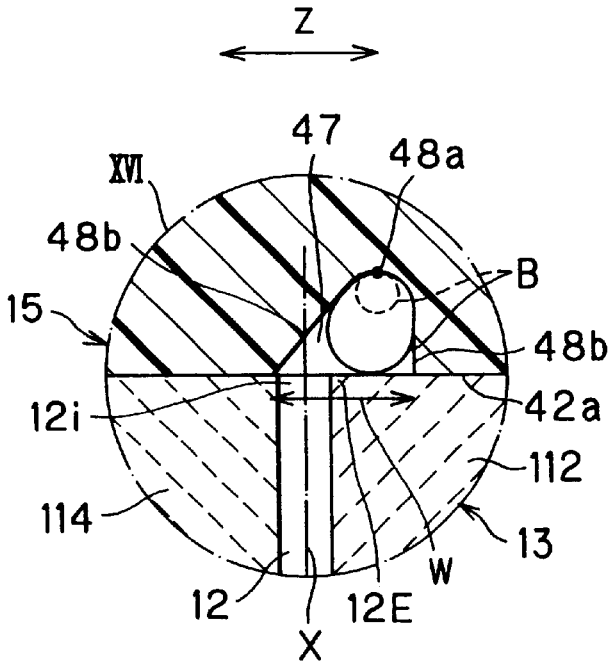
FIG. 16 is an enlarged cross-sectional side view of a portion XVI in FIG. 15, where the cross-sectional shape of a branch channel portion 47 is shown as connected to an inflow end 12*i* of one ejection channel 12.
Figure 17:
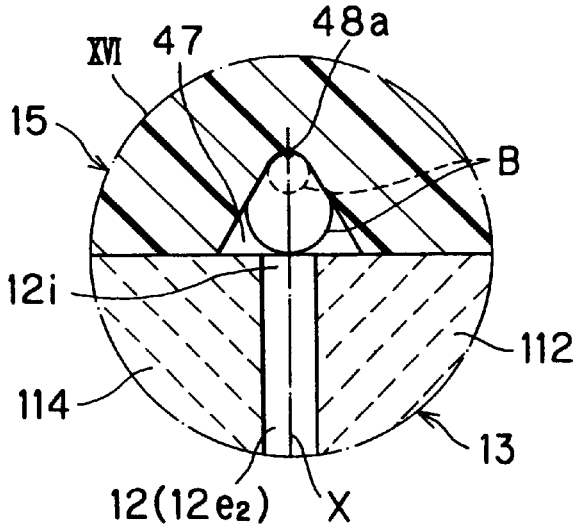
FIG. 17 is an enlarged cross-sectional side view of the portion XVI in FIG. 15 in a comparative example, where the cross-sectional shape of the branch channel portion 47 is shown as connected to an inflow end 12*i* of one ejection channel 12.

Additionally, in the first area 471, the branch channel portion 47 has a cross-sectional shape as shown in FIG. 16 and as indicated by solid line in FIG. 15. That is, the branch channel portion 47 is defined by a pair of inner side walls 48*b*. The pair of inner side walls 48*b* are sloping upwardly, and are joined together at the highest point (top point) 48*a*, which is located farthest away from the upper end surface 42*a* of the actuator 13. The highest point 48*a* (top portion) is shifted from the central axes X of the ejection channels 12 in a direction Z normal to the central axes X and to the row of ejection channels 12 (direction Y). The shift amount between the highest point 48*a* and the central axes X is fixed in the first area 471. However, in the second area 472, the shift amount gradually decreases toward a portion where the second end ejection channel 12*e*2 is located. The relationship between the branch channel portion 47 and the second end ejection channel 12*e*2 therefore becomes as shown in FIG. 17 and as indicated by dotted line in FIG. 15. That is, the highest point 48*a* becomes located on the central axis X of the second end ejection channel 12*e*2.

The branch channel portion 47 is designed, except at the position confronting the second end ejection channel 12*e*2, to have the cross-sectional shape as shown in FIG. 16 for the reasons described below.

An air bubble can be generated and accumulated also in the branch channel portion 47. It is now assumed that the branch channel portion 47 has the cross-sectional shape as shown in FIG. 17, in which the highest point 48*a* is located on the center axis X drawn through the center of the ejection channel 12. It is further assumed that one air bubble B is initially generated as indicated by the dotted line in that figure. After some time has elapsed, the air bubble B may possibly grow to the size indicated by the solid line. In this case, the air bubble B will obstruct the flow of ink into the ejection channel 12. It is noted that the air bubble B tends to reside at the highest point 48*a* of the branch channel portion 47. When the air bubble B grows to the size indicated by the solid line, a portion of the spherical external surface of the air bubble B, that is nearest to the inflow end 12*i* of the ejection channel 12, becomes centered directly over the inflow end 12*i*. This is because the highest point 48*a* is located on the central axis of the ejection channel 12. The air bubble B can therefore be easily drawn into the ejection channel 12, causing ejection problems such as printing imperfections.

It is noted that in order to solve the above-described problems or in order to prevent the problems from occurring, it is possible to control the purge device 35 to purge the air bubble B from the branch channel portion 47. That is, it is possible to remove, through suction, the ink containing the air bubble B. However, if the period of time, required before the grown air bubble B obstructs the ink flow path to the ejection channel 12, is short, then the purge operation must be executed frequently. As a result, not only is more time required before beginning a print operation, but also an increasing amount of ink is expended, decreasing the amount of ink available for actual printing.

In view of the above, according to the present embodiment, the cross-sectional shape of the branch channel portion 47 is designed as shown in FIG. 16, in order to decrease the amount of ejection problems caused by the air bubble B, and thereby maintaining high quality printing conditions for a longer time.

More specifically, as shown in FIG. 16, the highest point 48*a* is shifted from the central axes X of the ejection channels 12 in the direction Z which is normal to the central axis X and to the predetermined direction Y, in which the row of ejection channels 12 are arranged. Thus, the highest point 48*a* is off-center with respect to the ejection channels 12. One of the pair of inner side walls 48*b*, that confronts the inflow ends 12*i*, forms an acute angle with respect to the central axes X of the ejection channels 12, sloping upward toward the highest point 48*a*.

Especially, according to the present embodiment, the highest point 48*a* is positioned far enough off-center so as not to face the inflow ends 12*i* of the ejection channels 12. That is, the highest point 48*a* does not confront any parts of the inflow ends 12*i* of the ejection channels 12. More specifically, the highest point 48*a* is shifted from edges 12E of the inflow ends 12*i* in the direction Z normal to the direction Y and to the central axis X.

Thus, according to the present embodiment, the highest point 48*a* is located as shifted not only from the centers X of the ejection channels 12 but also from the outside edges 12E of the inflow ends 12*i* of the ejection channels 12. Accordingly, the distance between the highest point 48*a* and the inflow ends 12*i* of the ejection channels 12 is greatly increased while maintaining the cross-sectional area of the branch channel portion 47 almost unchanged or even while preventing the cross-sectional area from being greatly increased. With this structure, as the air bubble B grows from the condition indicated by the dotted line in FIG. 16 to the condition indicated by the solid line, even if the air bubble B grows at the same rate as in the case of FIG. 17, more time is required for the outer surface of the air bubble B to reach the inflow end 12*i* of the ejection channel 12.

Thus, in comparison to the case where the highest point 48*a* is located on the central axis X of the ejection channels 12, the air bubble B can be prevented for a comparatively long period of time from being drawn into the ejection channels 12, and favorable printing conditions can be maintained for a longer time. Therefore, the purge operation need not be executed frequently, improving the efficiency of printing operations and reducing the load on the maintenance system included in the purge device 35. Further, since the amount of ink expended in purge operations can be decreased, it is possible to increase the amount of ink available for actual printing.

According to the present embodiment, as shown in FIGS. 14 and 18, the highest point 48*a* of the branch channel portion 47 runs in the predetermined direction Y as parallel to the rows of ejection channels 12 in the first area 471. That is, the shift amount between the highest point 48*a* and the central axes X of the ejection channels 12 is fixed in the first area 471. The pair of inner side walls 48*b* extend parallel to each other and to the ejection channels 12 in the predetermined direction Y. Accordingly, the width W of the opened end of the branch channel portion 47 is maintained as fixed in the first area 471, where the width W is defined as a distance between the pair of side walls 48*b* at their lower ends along the upper end surface 42*a* as shown in FIG. 16. In other words, the width W is defined as a distance between inner edges of the central surface area 160 and the outside area 159 that sandwich the channel portion 47 therebetween as shown in FIG. 12A.

However, the branch channel portion 47 is designed in the second area 472, that is located farthest away from the inflow channel 16, differently from the first area 471.

The shape of the branch channel portion 47 in the second area 472 will be described below in greater detail with reference to FIG. 18, wherein the lower end surface 150 of the manifold 15 that is attached to the actuator 13 is indicated by hatching, and the highest point 48*a* of the branch channel portion 47 is indicated by a single dot chain line.

In the farthest end area 472 of the branch channel portion 47, the off-set amount (shift amount) defined between the highest point 48*a* and the central axes X of the ejection channels 12 in the direction Z gradually decreases toward the end wall 480 of the branch channel portion 47. The width W of the branch channel portion 47 gradually decreases toward the end wall 480.

The branch channel portion 47 is designed at the farthest end area 472 as described above for the reasons described below.

In general, air bubbles are generated also when liquid ink is initially introduced into the ink-jet print head 23. That is, when replacing the ink cartridge 25 with a new one, ink is initially drawn into the ink-jet print head 23 from the ink cartridge 25 utilizing the suction work of the purge device 35. At this time, air is also drawn into the ink-jet print head 23 together with the ink. This air has a tendency to form an air bubble in the ink near the second area 472 of each branch channel portion 47, which is located farthest away from the inflow channel 16. This air bubble can accumulate and grow, particularly when the ink-jet print head 23 is allowed to rest for some time.

Figure 19:
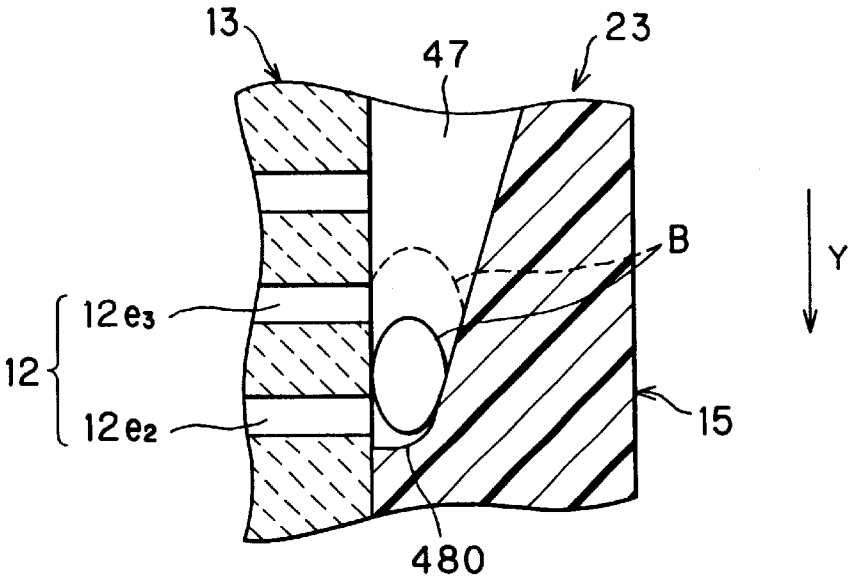
FIG. 19 is a side sectional view of an ink supply channel 14 in its end area taken along a line XIX—XIX in FIG. 18.

The present inventor performed an experiment, and confirmed that the air bubble B, accumulating in the farthest end area 472 of each branch channel portion 47 cannot easily reach the end surface 480 due to the spherical shape of the air bubble B as shown in FIGS. 18 and 19. In addition, as illustrated in FIG. 16, gaps are formed between the spherical surface of the air bubble B and the flat side surfaces 48*b* of the branch channel portion 47. This provides paths for the liquid ink to pass through to a connected ejection channel 12. Accordingly, the path for the ink to reach the second end ejection channel 12*e*2 is maintained until the air bubble B grows considerably large. It is noted that as the air bubble B grows from its initial condition indicated by the solid line in FIG. 19 to the condition shown by the dotted line, the air bubble B tends to grow in the upstream direction of the branch channel portion 47.

It is, however, relatively difficult to remove the air bubble B that is thus accumulated at the end of the branch channel portion 47 even through the purge operation. This is because only a small amount of ink can flow in the farthest end of the branch channel portion 47 during the purging operation. It becomes especially difficult to remove the air bubble B when the end ejection channel 12*e*2 is located as erroneously shifted away from the end wall 480 due to positioning error in attaching the manifold 15 to the actuator 13. Thus, ejection problems may likely occur in the farthest end ejection channel 12*e*2.

The above-described problem becomes even more striking when the highest point 48*a* is positioned as shifted from the central axis X of the farthest end ejection channel 12*e*2 and the highest point 48*a* does not face the inflow end 12*i* of the farthest end ejection channel 12*e*2. This is because the air bubble B tends to accumulate at the highest point 48*a* as described above, but the highest point 48*a* is positioned away from the inflow end 12*i* of that ejection channel 12*e*2 in this case.

Figure 20:
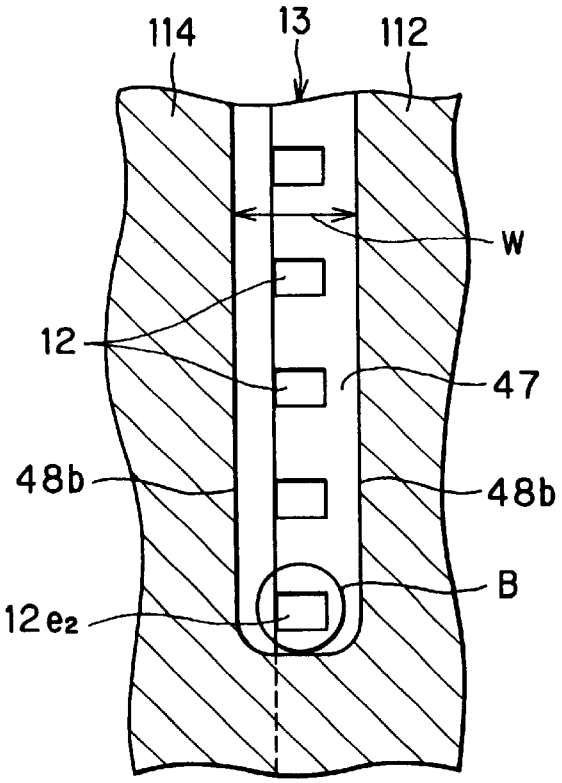
FIG. 20 a cross-sectional view of the ink supply channel in its end area of a comparative example.

The above-described problem is also striking when the branch channel portion 47 widely spreads, also at the farthest end area 472, over the inflow end 12*i* of the end ejection channel 12*e*2 as shown in FIG. 20. This is because also in such a case, the air bubble B may possibly be generated at a location away from the inflow end 12*i* of the end ejection channel 12*e*2. In other words, the problem becomes striking when the branch channel portion 47 is formed such that the pair of inner side walls 48*b* extend parallel all the way to the farthest end area 472 while maintaining the width W unchanged. In this case, an air bubble B accumulates not only in a position facing the inflow end 12*i* of the end ejection channel 12*e*2, but also in positions offset from the inflow end 12*i* of the end ejection channel 12*e*2. It is extremely difficult to remove, through suction by the purge device 35, the air bubble B that is positioned thus offset from the inflow end 12*i*.

According to the present embodiment, therefore, the branch channel portion 47 is designed at its farthest end area 472 as shown in FIG. 18. That is, the branch channel portion 47 is designed in the end area 472 so that as the branch channel portion 47 nears the farthest end wall 480, the highest point 48*a* becomes gradually closer to the central axis X of the end ejection channel 12*e*2 and so that the width W of the branch channel portion 47 gradually decreases.

With this arrangement, the cross-sectional shape of the branch channel portion 47 becomes essentially the same as that shown in FIG. 17 at its portion opposing the end ejection channel 12*e*2. The positional relationship between the branch channel portion 47 and the end ejection channel 12*e*2 becomes the same as that shown in FIG. 17.

It is now assumed that an air bubble B is generated and resides at the highest point 48*a* of the branch channel portion 47 at the farthest end area 472 as shown in FIG. 18. It is apparent that the air bubble B resides at the highest point 48*a*. Because the width W of the branch channel portion 47 gradually narrows and the shift amount between the highest point 48*a* and the ejection channel centers X gradually decreases toward the end wall 480, the air bubble B is brought to a position very close to the inflow end 12*i* of some ejection channel 12 (the farthest end ejection channel 12*e*2, an ejection channel 12*e*3 next to the ejection channel 12*e*2, or the like) that is located near the end wall 480 of the branch channel portion 47. Accordingly, when a purging operation is executed, the air bubble B thus collecting near the end wall 480 of the branch channel portion 47 as shown in FIG. 18 can be easily and effectively removed through some ejection channel 12.

As described already, as shown in FIGS. 12B and 13, the sloped surface 18 is provided to gradually increase the cross-sectional area of the ink flow path 45 toward the base channel portion 46 and further to spread to the branch channel portions 47. When liquid ink is initially introduced into the ink-jet print head 23 from the ink cartridge 25, the sloped surface 18 helps to reduce the speed of the introduced ink and to prevent air bubbles from being generated when the ink collides against the upper end surface 42*a* of the actuator 13. Hence, the sloped surface 18 effectively reduces the generation of air bubbles in the branch channel portions 47, and accordingly the combination of the sloped surface 18 and the above-described design of the branch channel portions 47 cooperate to effectively solve the air bubble-accompanying problems.

It is noted that many factors should be considered in designing the ink-jet print head 23 as described above, including wettability of the materials used to create the manifold 15; surface tension of the ink; distance between the farthest end wall 480 of the branch channel portion 47 and the inflow end 12*i* of the end ejection channel 12*e*2; curvature on the inner surface 480 at the farthest end of the branch channel portion 47; direction of gravity occurred to the ink-jet print head 23 when the ink-jet print head 23 is used; volume of the air bubble B; depths of the ejection channels 12, and the like.

As described above, according to the ink-jet print head of the above-described embodiments, the actuator 13 is formed with the plurality of ejection channels 12 in two rows for accommodating a liquid ink and for ejecting drops of liquid ink from the nozzles 10 in the nozzle plate 11. The manifold 15 is joined with the actuator 13 at its inflow end side 42*a*.

The manifold 15 is formed with the ink supply channel 14, which is opened over all the ejection channels 12 for supplying liquid ink to the ejection channels. The ink supply channel 14 extends along the two rows of ejection channels. The inflow channel 16 is further provided in fluid communication with the ink supply channel 14. Liquid ink is supplied to the ink supply channel 14 through the inflow channel 16 from the ink supply source 25.

The sloped surface 18 is further provided between the inner wall surface defining the inflow channel 16 and the inner wall surface defining the ink supply channel 14. The sloped surface 18 defines the ink flow path 45 for flowing the ink from the inflow channel 16 to the ink supply channel 14, and gradually increases the cross-sectional area of the inflow channel 16 toward the ink supply channel 14. By providing this sloped surface 18, ink supplied from the ink supply source 25 to the inflow channel 16 flows along the sloped surface 18 into the ink supply channel 14. As the cross-sectional area of the ink flow path 45 gradually increases due to the sloped surface 18, the rate of flow of the ink gradually decreases. Accordingly, the liquid ink flows more gently into the ink supply channel 14. As a result, ink introduced into the ink supply channel 14 does not forcibly hit the inflow end side surface 42*a* of the actuator 13 where the ejection channels 12 are opened. The ink does not generate air bubbles. Hence, generation of air bubbles in the ink supply channel 14 can be effectively restrained to prevent ejection problems from occurring.

Especially, the sloped surface 18 slopes in the direction toward the end ejection channels 12*e*2 that are disposed farthest away from the inflow channel 16. By sloping the sloped surface in this manner, the ink flowing from the inflow channel 16 into the ink supply channel 14 flows along the sloped surface 18 toward the end ejection channels 12*e*2. As a result, ink can be smoothly supplied even to the end ejection channels 12*e*2 without generating air bubbles.

The stepped portion 43 is additionally formed on the sloped surface 18 for trapping air bubbles formed in the liquid ink. The filter 54 is installed at the entrance of the inflow channel for preventing foreign matter from entering the ink supply channel. However, fine air bubbles that are generated in the ink supply channel 14 can gather on this filter and grow. Those air bubbles contact the filter and form a meniscus in the fine openings of the filter. A holding force created from the surface tension of the meniscus and the like can hinder movement of the air bubbles, thereby blocking the flow of ink. However, by forming the stepped portion 43, the air bubbles can be trapped before they migrate to the entrance of the inflow channel. Not only are the air bubbles prevented from contacting the filter, but also the air bubbles trapped on the stepped portion 43 can be easily moved by the ink flow, even if they accumulate and grow large. Hence, the ink flow will not be blocked by the air bubbles.

The ink supply channel 14 (47) has approximately the U-shaped cross-section. More specifically, the inner wall surface 17 (48*b*) formed in the manifold 15 to define the ink supply channel 14 (47) is designed to form a concave-shaped cavity whose width gradually decreases in a direction away from the inflow end side surface 42*a* of the actuator 13 where the ejection channels are opened. By thus forming the inner wall surface of the ink supply channel, it is possible to cause air bubbles to accumulate in the portion 17*a* (48*a*) of the ink supply channel farthest away from the inflow ends 12*i* of the ejection channels. Accordingly, the air bubbles will not likely be drawn into the ejection channels, and ejection problems can be prevented.

The portion 17*a* (48*a*), in the concave-shaped ink supply channel 14 (47), farthest away from the inflow ends 12*i* of the ejection channels 12, is positioned as shifted from the centerlines X of the ejection channels. In other words, the highest position 17*a* (48*a*) of the ink supply channel 14 (47) is located offset from the imaginary lines X passing through the centers of the ejection channels 12. Because air bubbles will accumulate in the highest position 17*a* (48*a*), the air bubbles will not likely be drawn into the ejection channels 12, and ejection problems can be effectively prevented.

More specifically, because the highest portion 17*a* (48*a*) of the ink supply channel 14 (47) is thus located off-center in relation to the ejection channels 12, the distance between the highest point 17*a* (48*a*) and the inflow ends 12*i* of the ejection channels can be increased, as compared to when the highest point 17*a* (48*a*) is located over the ejection channel centers X, even while maintaining the cross-sectional area of the ink supply channel 14 (47) fixed or even while preventing the cross-sectional area from increasing greatly. Accordingly, it takes a longer time for the outer surface of air bubbles to grow and reach the inflow ends of the ejection channels. The air bubbles can be prevented for a comparatively long time from being drawn into the ejection channels, and favorable printing conditions can be maintained for a long time. Therefore, the purge operation need not be executed frequently, improving the efficiency of printing operations and reducing the load on the maintenance system included in the purging device. Further, since the amount of ink expended in purge operations can be decreased, it is possible to increase the amount of ink available for actual printing.

Especially, the highest point 17*a* (48*a*) in the ink supply channel 14 (47) is located off-set from the center lines X of the ejection channels 12 so as not to oppose the inflow ends 12*i* of the ejection channels 12. Because the highest point 17*a* (48*a*) of the ink supply channel 14 (47) is not opposite the inflow ends 12*i* of the ejection channels, the distance between this highest point 17*a* (48*a*) and the inflow ends 12*i* of the ejection channels can be increased even farther. It is therefore possible to further increase the amount, with which the highest point 17*a* (48*a*) is offset from the inflow ends 12*i* of the ejection channels, thereby further improving effectiveness and reliability of the ink supply channel.

Especially, according to the second embodiment, the highest point 48*a* in each branch channel portion 47 is located off-set from the center lines X of the ejection channels 12 in a corresponding row so as not to oppose the inflow ends 12*i* of the ejection channels. The branch channel portion 47 is further designed that the highest point 48*a* is gradually shifted to become close to the imaginary centerline X of the ejection channels in a direction toward the end 480 of the branch channel portion 47 that is farthest apart from the inflow channel 16. With this structure, it is possible to more easily and effectively remove, through the purge operation, air bubbles that tend to collect in the farthest end of the branch channel portion 47 when ink is first introduced to the ink supply channel. By thus forming the highest point 48*a* at the far end of the ink supply channel such that the highest point 48*a* gradually nears the centerline X of the ejection channel 12 as the branch channel 47 nears the far end 480, it is possible to more easily and effectively remove, through the purge operation, the air bubbles that tend to collect in the far end of the branch channel when ink is first introduced. Accordingly, it is possible to prevent ejection problems caused by air bubbles that accumulate at the far end of the branch channel when ink is initially introduced to the ink supply channel and, particularly, after the ink-jet print head has been unused for some time. As a result, it is possible to improve the reliability in achieving high quality printing conditions.

Each branch channel 47 extends along the inflow ends 12*i* of the ejection channels 12 in a corresponding row, with its width W becoming narrower toward the far end of the branch channel. Accordingly, an air bubble, that tends to collect in the far end of the branch channel when the ink is first introduced, are brought to a position very close to the inflow end 12*i* of some ejection channel that is located at the far end of the ink supply channel. The air bubble can therefore be easily and effectively removed through the purge operation through that ejection channel. Accordingly, it is possible to prevent ejection problems caused by air bubbles accumulating at the far end of the ink supply channel.

When the width of the branch channel thus decreases toward the far end thereof, even if the highest point 48*a* of the ink supply channel 47 is offset from the centerlines of all the ejection channels in the end area 472, it is still possible to cause an air bubble to be located sufficiently close to one ejection channel at the channel far end. Accordingly, the air bubble can be easily removed through the purging process.

Especially, according to the second embodiment, the ejection channels 12 are disposed in the plurality of rows. The ink supply channel 14 is designed to have the base channel portion 46, which is in fluid communication with the inflow channel 16 and which is commonly shared by all the ejection channel rows at one end of each row. That is, the base channel portion 46 is in fluid communication with all the ejection channel rows at the one end thereof. The ink supply channel 14 is designed to fork into the plurality of branch channel portions 47, each of which is communicated with a corresponding ejection channel row at the other end of the row. The sloped surface 18 is provided over the base end channel portion 46 to gradually widen from the inflow channel side to the branch channel portions 47.

The ejection channels 12 are thus provided in the plurality of rows, and the ink supply channel 14 is divided into the plurality of branch channel portions 47 in one to one correspondence with the ejection channel rows. Accordingly, it is possible to decrease the entire volume of the ink supply channel 14. In addition, ink flowing into the ink supply channel from the inflow channel 16 can flow along the sloped surface 18 into each of the plurality of branch channel portions 47. Accordingly, ink can be smoothly supplied to each ejection channel row. Hence, it is possible to effectively suppress the accumulation of air bubbles in the ink supply channel when ink is introduced into the same.

Because the ink supply channel 14 is formed with the plurality of branch channel portions 47 in one to one correspondence with the ejection channel rows, it is impossible to set the cross-sectional area of each branch channel portion to be large. Accordingly, it is especially effective to locate the highest point 48*a* of the ink supply channel 47 as off-center from the ejection channels 12.

In addition, because the cross-sectional area of each branch channel portion 47 is thus small, even though the purge load can be reduced, the air bubbles cannot be allowed to accumulate for a long period of time until being drawn into the ejection channels. However, because the highest point 48*a* of the branch channel portion 47 is offset from the centerlines of the ejection channels, it is possible to increase the time required for the external surface of the air bubbles to grow as far as the inflow ends 12*i* of the ejection channels. In addition, it is possible to effectively remove air bubbles collected in the far end of the ink supply channel when the width of the ink supply channel is set to become narrower toward the far end of the ink supply channel.

While the invention has been described in detail with reference to the specific embodiments thereof, it would be apparent to those skilled in the art that various changes and modifications may be made therein without departing from the spirit of the invention, the scope of which is defined by the attached claims.

For example, the actuator 13 in the above-described embodiments employs a piezoelectric ceramic element, which ejects ink from the ejection channels 12 when transformed by an electric field. However, an actuator employing a thermal element, for example, can be used instead, and a thermal head type ink-jet print head 23 can be produced.

In the embodiments described above, the inflow channel 16 is connected in fluid communication with one end of the ink supply channel 14, and the sloped surface 18 is provided on one side of the inner wall 17. However, it is also possible to provide the inflow channel 16 in fluid communication with substantially the center portion of the ink supply channel 14 and to provide a pair of sloped surfaces 18 on both sides of the inflow channel 16.

In the above description, the actuator 13 is formed with ejection channels 12 in two rows. However, these ejection channels 12 can also be formed in one row or in three or more rows.

The direction, in which the highest point 48*a* of the branch channel portion 47 is offset from the centerline X of each ejection channel 12, can be opposite to that shown in the drawings.

In the second embodiment, the sloped surface 18 is provided, the highest point 48*a* of each branch channel portion 47 is shifted from the inflow ends 12*i* of the ejection channels 12, the highest point 48*a* is set to become gradually close to the inflow end of the end ejection channel 12*e*2 in a direction toward the end 480 of the branch channel portion 47, and the width W of the branch channel portion 47 is set to become narrower toward its end 480. However, it is possible to sufficiently solve the air bubble-accompanying problems through employing at least one of the above-described specific designs.

That is, it is sufficient that the ink-jet print head 23 be provided with the sloped surface 18 on the inner side surface between the inflow channel 16 and the ink supply channel 14. The sloped surface 18 gradually increases the cross-sectional area of the ink flow path 45 from the inflow channel 16 toward the ink supply channel 14. Accordingly, as the ink flows along the sloped surface 18 into the ink supply channel 14, the rate of flow of the ink gradually decreases due to the increased cross-sectional area. As a result, the liquid ink flows more gently into the ink supply channel 14.

Each branch channel 47 may be designed so that the highest point 48*a* is offset from the imaginary centerlines X running through all the ejection channels 12. With this construction, it is possible to increase the time required for the external surface of the air bubble B to grow as far as the inflow end of the ejection channel 12. As a result, the amount of time required before ink supplied to the ejection channel 12 is obstructed by the air bubble B can be increased, thereby reducing the frequency of required purge operations.

The branch channel 47 may be designed so that its width becomes narrower toward the farthest end of the branch channel 47. Accordingly, the air bubble B can be brought to a position very close to the inflow end of some ejection channel 12 that is located near to the farthest end of the branch channel 47. As a result, the air bubble can be more easily and effectively removed through that ejection channel 12 by performing a purge operation when ink is initially introduced into the ink-jet print head 23. In this case, the branch channel 47 may be designed so that the highest point 48*a* be shifted from the center lines X of the ejection channels 12. The branch channel 47 may also be designed so that the highest point 48*a* be positioned on the central axes X of the ejection channels 12.

The design of each branch channel portion 47 in the second embodiment can be applied to the ink supply channel 14 of the first embodiment when the ink supply channel 14 is provided in correspondence with a single row of ejection channels 12. That is, the highest point 17*a* of the ink supply channel 14 may be shifted from the inflow ends 12*i* of the ejection channels 12, while the highest point 17*a* becoming gradually close to the inflow end 12*i* of the end ejection channel 12*e*2 in a direction toward the second end 14*e*2 of the ink supply channel 14. The width of the ink supply channel 14 may become narrower toward its end 14*e*2.

In the above-described embodiments, the actuator 13 is produced from the central plate 114 and the base plates 112. However, the actuator 13 may be produced in other various designs.

In the first embodiment, as shown in FIG. 5, the ink supply channel 14 is designed so that the height of the ink supply channel 14 gradually decreases in the direction Y in the second end portion 14*e*2. In the second embodiment, as shown in FIG. 19, the branch channel portion 47 is designed so that the height of the branch channel portion 47 gradually decreases in the direction Y at least in the farthest end area 472. However, the ink supply channel 14 and the branch channel portion 47 may be designed in other manners. For example, the height of them may be set as fixed.

What is claimed is:

1. An ink-jet print head comprising:

an actuator formed with a plurality of ejection channels, the actuator having a predetermined surface, on which the plurality of ejection channels are opened to have their opened ends;

a first wall, in confrontation with the predetermined surface, for defining an ink supply channel for supplying the liquid ink to the plurality of ejection channels through their opened ends;

a second wall defining an inflow channel in fluid communication with the ink supply channel, the inflow channel being for supplying ink to the ink supply channel; and a sloped surface formed between the first wall and the second wall for defining an ink flow path for allowing ink to flow from the inflow channel to the ink supply channel, the sloped surface gradually increasing the cross-sectional area of the ink flow path in a direction toward the ink supply channel.

2. An ink-jet print head as claimed in claim 1, wherein the plurality of ejection channels are arranged in at least one row, the ink supply channel extending along the at least one row of the ejection channels.

3. An ink-jet print head as claimed in claim 1, wherein the ejection channels in each row include an end ejection channel that is located farthest away from the inflow channel, the sloped surface being slanted in a direction toward the end ejection channel.

4. An ink-jet print head as claimed in claim 3, further comprising a stepped portion formed on the sloped surface for trapping air bubbles formed in the liquid ink.

5. An ink-jet print head as claimed in claim 2, wherein the first wall is shaped to provide the ink supply channel substantially of a U-shaped cross-section, a width of the ink supply channel decreasing in a direction away from the predetermined surface to form a top portion which is located farthest away from the predetermined surface.

6. An ink-jet print head as claimed in claim 5, wherein the ink supply channel extends along the at least one row of the ejection channels between a first end portion and a second end portion which are opposite to each other, the ink supply channel being in fluid communication with the ink flow path at the first end portion, the end ejection channel being opened on the predetermined surface to be exposed in the second end portion of the ink supply channel, the top portion of the ink supply channel extending between the first and second end portions.

7. An ink-jet print head as claimed in claim 6, wherein the top portion is located as shifted from an imaginary line, which extends through a central axis of at least one ejection channel in each of the at least one row, in a direction perpendicular both to the central axis and to each row.

8. An ink-jet print head as claimed in claim 7, wherein the top portion extends along the at least one row of the ejection channels, the top portion being located as shifted from imaginary lines which extend through central axes of all the ejection channels in each row in a direction perpendicular both to the central axes and to each row.

9. An ink-jet print head as claimed in claim 6, wherein the top portion is shifted from an edge of the opened end of the at least one ejection channel in each row in the direction perpendicular both to the central axis and to each row so as not to face the opened end of the at least one ejection channel.

10. An ink-jet print head as claimed in claim 9, wherein the top portion is shifted from edges of the opened ends of all the ejection channels in each row in the direction perpendicular both to the central axes and to each row so as not to face the opened ends of all the ejection channels.

11. An ink-jet print head as claimed in claim 7, wherein a distance, defined between the top portion and the imaginary line extending through a central axis of each ejection channel defined in a direction perpendicular both to the central axis and to each row, decreases toward the second end portion of the ink supply channel.

12. An ink-jet print head as claimed in claim 11, wherein the ink supply channel includes a first part and a second part between the first and second end portions, the second part including the second end portion, the first part being located nearer to the first end portion than the second part, and wherein the top portion of the ink supply channel at the first part is shifted from central axes of ejection channels, whose open ends are exposed in the first part of the ink supply channel, in the direction perpendicular to the central axis and to each row of ejection channels, and wherein the distance, defined between the top portion of the ink supply channel at the second part and the imaginary lines extending through central axes of ejection channels, whose open ends are exposed in the second part of the ink supply channel, in the direction perpendicular both to the central axes and to the row, decreases toward the second end portion of the ink supply channel.

13. An ink-jet print head as claimed in claim 12, wherein the top portion of the ink supply channel at the second end portion is located on the central axis of the end ejection channel.

14. An ink-jet print head as claimed in claim 6, wherein a width of the ink supply channel defined along the predetermined surface decreases toward the second end portion.

15. An ink-jet print head as claimed in claim 14, wherein the ink supply channel includes a first part and a second part between the first and second end portions, the second part including the second end portion, the first part being located nearer to the first end portion than the second part, and wherein the width of the ink supply channel, defined along the predetermined surface, is maintained unchanged in the first part, and decreases gradually toward the second end portion in the second part.

16. An ink-jet print head as claimed in claim 1, wherein the ejection channels are arranged in a plurality of rows, the ink supply channel having a plurality of channel portions in one to one correspondence with the plurality of rows so that each channel portion being in fluid communication with at least one of the ejection channels of the corresponding row.

17. An ink-jet print head as claimed in claim 16, wherein the ink supply channel further includes a base channel portion which is located in fluid communication with the ink flow path, the plurality of channel portions extending from the base end channel portion, the ejection channels in each row having a first end ejection channel that is located most near to the inflow channel and a second end ejection channel that is located farthest away from the inflow channel, the opened ends of the first end ejection channels in all the rows being exposed in the base channel portion and the opened end of the second end ejection channel of each row being exposed in the corresponding channel portion.

18. An ink-jet print head as claimed in claim 17, wherein the sloped surface is provided facing the base channel portion to spread in a direction from the inflow channel toward all the channel portions.

19. An ink-jet print head as claimed in claim 1, wherein the actuator further has another predetermined surface opposite to the predetermined surface, each of the plurality of ejection channels extending between the predetermined surface and the other predetermined surface, wherein the p redetermined surface of the actuator is connected to a manifold formed with the first wall defining the ink supply channel, the second wall defining the ink flow channel, and the sloped surface defining the ink flow path, and further comprising a nozzle plate formed with a plurality of nozzles in fluid communication with the plurality of ejection channels.

20. An ink-jet print head comprising:

an actuator formed with a plurality of ejection channels for accommodating a liquid ink and for ejecting drops of the liquid ink, the plurality of ejection channels being arranged in at least one row which extends in a predetermined direction, the actuator having a predetermined surface, on which each of the ejection channels is opened to have an inflow end for receiving the liquid ink flowing into the ejection channel;

a manifold joined with the actuator on the predetermined surface, the manifold being formed with an ink supply channel which extends substantially along the predetermined direction in fluid communication with the inflow ends of the ejection channels to supply liquid ink to the ejection channels, the ink supply channel having a top portion which is located farthest away from the predetermined surface and which extends substantially along the predetermined direction, the top portion being located as shifted from a center of at least one ejection channel in a direction normal to the predetermined direction.

21. An ink-jet print head as claimed in claim 20, wherein the top portion of the ink supply channel is located as shifted from an edge of the at least one ejection channel in the direction normal to the predetermined direction so that the top portion does not face the inflow end of at least one ejection channel.

22. An ink-jet print head as claimed in claim 20, wherein the ink supply channel extends in the predetermined direction between a first end portion and a second end portion, the ink supply channel having a first part and a second part, the first part including the first end portion and the second part including the second end portion, the manifold being further formed with an inflow channel connected to the first end portion of the ink supply channel to supply ink to the ink supply channel, the inflow ends of the ejection channels in each of the at least one row being arranged in the ink supply channel between the first and second end portions, a shift amount of the top portion from the center of each ejection channel in the direction normal to the predetermined direction decreases in the second part toward the second end portion.

23. An ink-jet print head as claimed in claim 22, wherein the ink supply channel has a width along the predetermined surface in the direction normal to the predetermined direction, the width decreasing in the second part toward the second end portion.

24. An ink-jet print head as claimed in claim 20, wherein the plurality of ejection channels are formed in a plurality of rows, each row extending in the predetermined direction, and the ink supply channel has a plurality of branch channel portions in one to one correspondence with the plurality of rows, each branch channel portion extending in the predetermined direction.

25. An ink-jet print head as claimed in claim 24, wherein each branch channel portion has a top portion which is located farthest away from the predetermined surface and which extends substantially along the predetermined direction, the top portion being located as shifted from a center of at least one ejection channel in the direction normal to the predetermined direction.

26. An ink-jet print head as claimed in claim 25, wherein the top portion of each branch channel portion is located as shifted from an edge of the at least one ejection channel in the direction normal to the predetermined direction so that the top portion does not face the inflow end of at least one ejection channel.

27. An ink-jet print head as claimed in claim 26, wherein the ink supply channel further has a base channel portion connected to a first end of each branch channel portion, the manifold being further provided with an inflow channel connected to the base channel portion to supply ink to the base channel portion, and wherein each branch channel portion extends in the predetermined direction between the first end and a second end opposed to the first end, each branch channel portion having a first portion and a second portion, the first portion including the first end and the second portion including the second end, the ejection channels in each row being arranged such that the inflow ends of several ejection channels are arranged in the corresponding branch channel portion between the first and second ends, a shift amount of the top portion from the center of each ejection channel in the direction normal to the predetermined direction decreases in the second portion toward the second end.

28. An ink-jet print head as claimed in claim 27, wherein each branch channel portion has a width along the predetermined surface in the direction normal to the predetermined direction, the width decreasing in the second portion toward the second end.

29. An ink-jet print head comprising:

an actuator formed with a plurality of ejection channels for accommodating a liquid ink and for ejecting drops of the liquid ink, the ejection channels being arranged in at least one row which extends in a predetermined direction, the actuator having a predetermined surface, on which each of the ejection channels is opened to have an inflow end;

manifold joined with the actuator on the predetermined surface, the manifold being formed with an ink supply channel which extends along the at least one row of ejection channels for supplying liquid ink to each of the ejection channels, the manifold being further formed with an inflow channel connected to a first end of the ink supply channel to supply ink to the ink supply channel, the ink supply channel extending substantially in the predetermined direction between a first end and a second end opposite to the first end, the ejection channels in each of the at least one row being arranged so that their inflow ends are exposed in the ink supply channel between the first and second ends, the ink supply channel having a width along the predetermined surface, the width of the ink supply channel at its portion close to the second end decreasing toward the second end;

wherein the ink supply channel has a top portion located farthest away from the predetermined surface, the top portion extending substantially in the predetermined direction, the top portion being positioned as shifted from a central axis of at least one ejection channel in a direction normal to the predetermined direction.

30. An ink-jet print head as claimed in claim 29, wherein the top portion of the ink supply channel is located as shifted from an edge of the at least one ejection channel in the direction normal to the predetermined direction so as not to face the inflow end of the at least one ejection channel.

31. An ink-jet print head as claimed in claim 29, wherein a shift amount, in the direction normal to the predetermined direction, of the top portion from the central axis in each of ejection channels, whose inflow ends are located in a portion of the ink supply channel close to the second end, decreases toward the second end.

32. An ink-jet print head as claimed in claim 29, wherein the plurality of ejection channels are formed in a plurality of rows, each row extending in the predetermined direction, wherein the ink supply channel has a plurality of branch channel portions in one to one correspondence with the plurality of rows, each branch channel portion extending in the predetermined direction, the ink supply channel further having a base channel portion connected to a first end of each branch channel portion, the inflow channel being connected to the base channel portion to supply ink to the base channel portion, and wherein each branch channel portion extends substantially in the predetermined direction between the first end and a second end opposed to the first end, each branch channel portion having a first portion and a second portion, the first portion including the first end and the second portion including the second end, the ejection channels in each row being arranged such that the inflow ends of several ejection channels are arranged in the corresponding branch channel portion between the first and second ends, a width of each branch channel portion decreasing in the second portion toward the second end.

* * * * *